US012723374B2

(12) United States Patent
Matsuhashi

(10) Patent No.: US 12,723,374 B2
(45) Date of Patent: Sep. 1, 2026

(54) SHOVEL AND SHOVEL CONTROL SYSTEM

(71) Applicant: SUMITOMO CONSTRUCTION MACHINERY CO., LTD., Tokyo (JP)

(72) Inventor: Yuiki Matsuhashi, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 9 days.

(21) Appl. No.: 18/985,764

(22) Filed: Dec. 18, 2024

(65) Prior Publication Data

US 2025/0215666 A1 Jul. 3, 2025

(30) Foreign Application Priority Data

Dec. 28, 2023 (JP) ..... 2023-222736

(51) Int. Cl.
*E02F 9/24* (2006.01)
*E02F 9/26* (2006.01)

(52) U.S. Cl.
CPC ..... *E02F 9/24* (2013.01); *E02F 9/262* (2013.01)

(58) Field of Classification Search
CPC ... E02F 9/24; E02F 9/262; E02F 9/205; E02F 9/261; E02F 3/283; E02F 3/32
See application file for complete search history.

(56) References Cited

FOREIGN PATENT DOCUMENTS

JP 2014-224411 12/2014
KR 20140009148 A * 1/2014 ..... F04B 49/065

* cited by examiner

*Primary Examiner* — Daryl C Pope
(74) *Attorney, Agent, or Firm* — IPUSA, PLLC

(57) ABSTRACT

A shovel includes a lower traveling body; an upper turning body turnably mounted on the lower traveling body; an imaging device attached to the upper turning body; a display device; and circuitry configured to display, on the display device, position information representing a relationship between positions of a person detected by the imaging device and the shovel and when the person whose position is represented in the position information is no longer detected by the imaging device, continue to display the position of the person who is no longer detected in the position information in a case where a predetermined condition is satisfied.

6 Claims, 12 Drawing Sheets

SYS

SHOVEL AND SHOVEL CONTROL SYSTEM

CROSS-REFERENCE TO RELATED APPLICATIONS

This application is based upon and claims priority to Japanese Patent Application No. 2023-222736 filed on Dec. 28, 2023, the entire contents of which are incorporated herein by reference.

BACKGROUND

1. Technical Field

The present disclosure relates to a shovel, and a control system for a shovel.

2. Description of Related Art

A conventional technique has been proposed for detecting an object existing around a shovel and monitoring the surroundings of the shovel.

SUMMARY

According to an embodiment of the present disclosure, a shovel is provided. The shovel includes a lower traveling body;

an upper turning body turnably mounted on the lower traveling body;

an imaging device attached to the upper turning body;

a display device; and circuitry configured to display, on the display device, position information representing a relationship between positions of a person detected by the imaging device and the shovel and when the person whose position is represented in the position information is no longer detected by the imaging device, continue to display the position of the person who is no longer detected in the position information in a case where a predetermined condition is satisfied.

In addition, according to another embodiment of the present disclosure, a control system for a shovel is provided. The control system includes a shovel including a lower traveling body, an upper turning body turnably mounted on the lower traveling body, and an imaging device attached to the upper turning body;

a display device; and circuitry configured to display, on the display device, position information representing a relationship between positions of a person detected by the imaging device and the shovel and when the person whose position is represented in the position information is no longer detected by the imaging device, continue to display the position of the person who is no longer detected in the position information in a case where a predetermined condition is satisfied.

DETAILED DESCRIPTION

Figure 1:
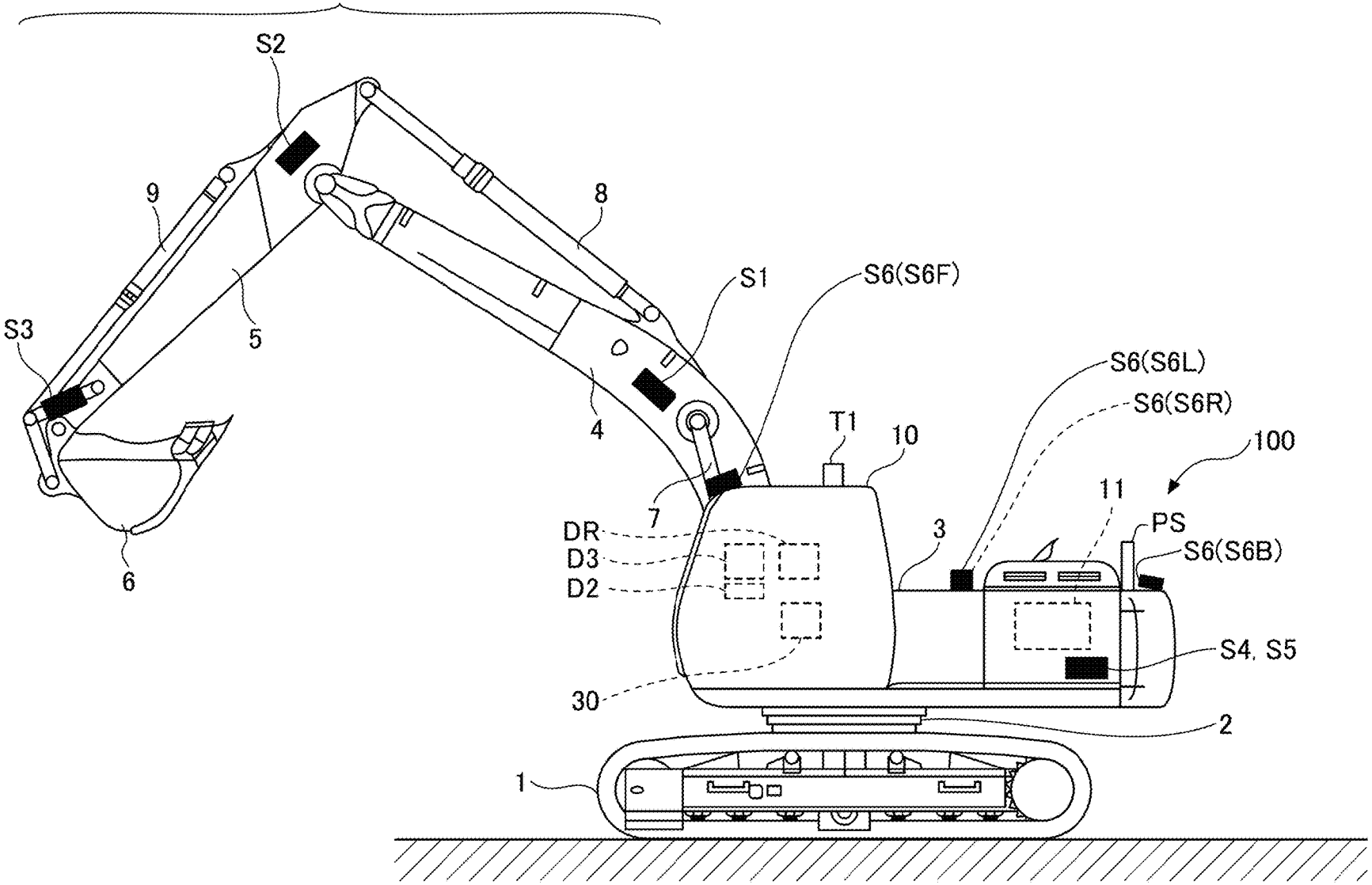
FIG. 1 is a side view illustrating an example of a shovel according to an embodiment.

The conventional technique describes a technique for detecting an object existing around a work machine by using a stereo camera. However, there is a possibility that the detection of the object using a detection device such as the stereo camera is not appropriately performed depending on a surrounding environment or the like.

According to an aspect of one embodiment of the present disclosure, a technique is proposed for improving safety by continuing to display a position of a person when the person is no longer detected by a space recognition device and a predetermined condition is satisfied.

According to one aspect of the invention, safety can be improved by displaying the presence of a person around a shovel.

Hereinafter, embodiments of the present disclosure will be described with reference to the accompanying drawings. The embodiments described below are not intended to limit the invention but are merely examples, and all features and combinations thereof described in the embodiments are not necessarily essential to the invention. In the drawings, the same or corresponding components are denoted by the same or corresponding reference numerals, and the description thereof may be omitted.

In the following embodiments of the present disclosure, an example of using a shovel as an example of a work machine will be described, but the work machine is not limited to the shovel. The present disclosure may be applied to a construction machine, a standard machine, an applied machine, a forestry machine, or a conveyance machine based on a hydraulic shovel.

Embodiment

Figure 2:
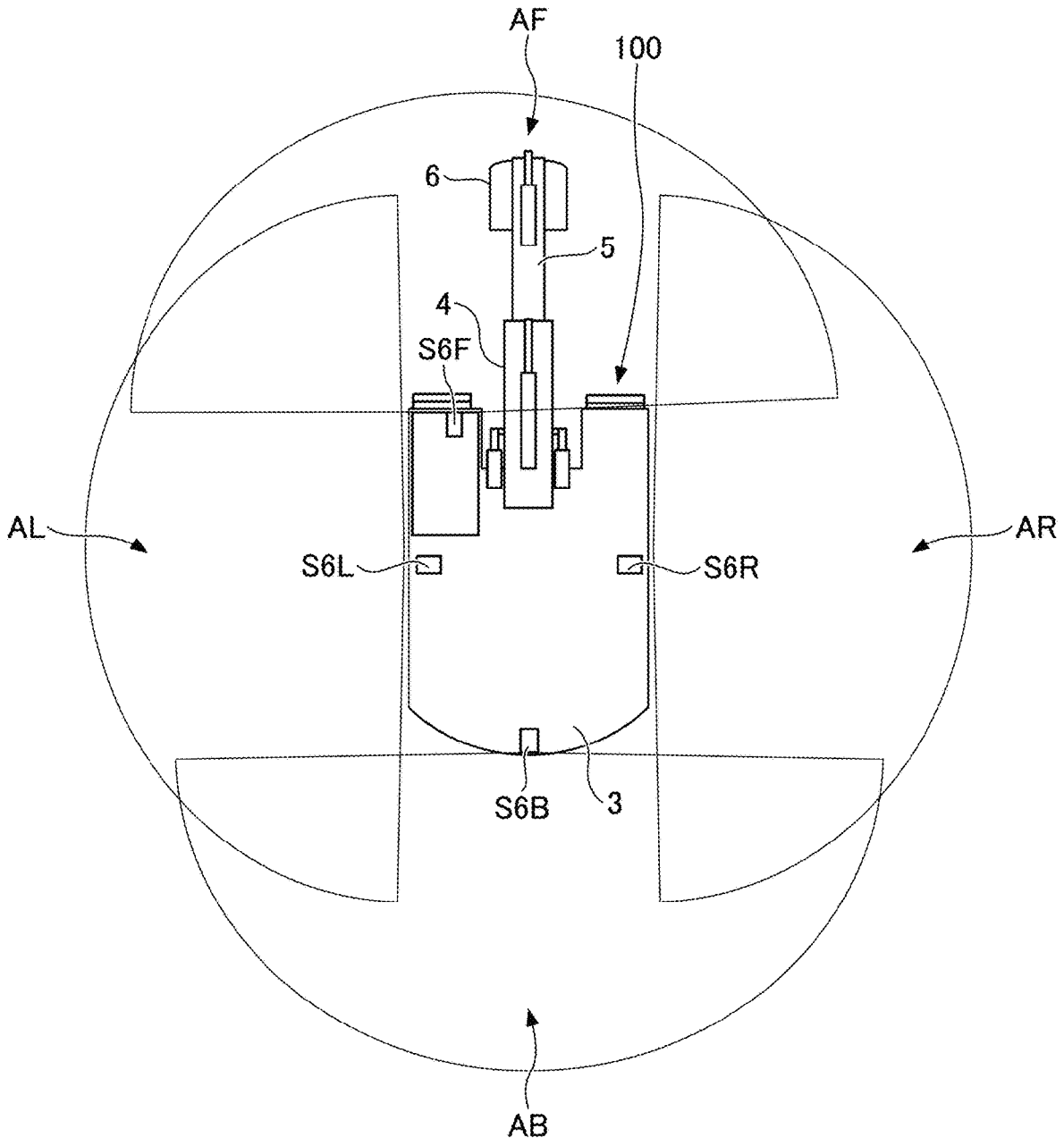
FIG. 2 is a top view illustrating an example of the shovel according to the embodiment.

First, an overview of a shovel 100 according to the present embodiment will be described with reference to FIG. 1. FIG. 1 is a side view of the shovel 100 according to an embodiment. FIG. 2 is a top view of the shovel 100 according to an embodiment.

An upper turning body 3 is turnably mounted on a lower traveling body 1 of the shovel 100 via a turning mechanism 2. A boom 4 is attached to the upper turning body 3. An arm 5 is attached to the distal end of the boom 4, and a bucket 6 as an end attachment is attached to the distal end of the arm 5. The end attachment may be a bucket for a slope face or a bucket for dredging.

The boom 4, the arm 5, and the bucket 6 constitute an excavation attachment which is an example of the attachment AT, and are hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. The excavation attachment may be provided with a bucket tilt mechanism.

The boom angle sensor S1 detects the rotation angle of the boom 4. In the present embodiment, the boom angle sensor S1 is an accelerometer, and can detect a boom angle that is a rotation angle of the boom 4 with respect to the upper turning body 3. The boom angle is, for example, a minimum angle when the boom 4 is lowered to the lowest position, and increases as the boom 4 is raised.

The boom angle sensor S1 may include, for example, a rotary encoder, an accelerometer, a six-axis sensor, an inertial measurement unit (IMU), and the like. The boom angle sensor S1 may include potentiometers using a variable resistor, a cylinder stroke sensor that detects a stroke amount of a hydraulic cylinder (boom cylinder 7) corresponding to the boom angle, and the like. The same applies to the arm angle sensor S2, the bucket angle sensor S3, and a body inclination sensor S4. A detection signal corresponding to the boom angle by the boom angle sensor S1 is incorporated into a controller 30.

The arm angle sensor S2 detects the rotation angle of the arm 5. In the present embodiment, the arm angle sensor S2 is an accelerometer, and can detect an arm angle which is a rotation angle of the arm 5 with respect to the boom 4. The arm angle is, for example, a minimum angle when the arm 5 is closed to the maximum, and increases as the arm 5 is opened.

The bucket angle sensor S3 detects the rotation angle of the bucket 6. In the present embodiment, the bucket angle sensor S3 is an accelerometer, and can detect a bucket angle which is a rotation angle of the bucket 6 with respect to the arm 5. The bucket angle is, for example, a minimum angle when the bucket 6 is closed to the maximum, and increases as the bucket 6 is opened.

The boom angle sensor S1, the arm angle sensor S2, and the bucket angle sensor S3 may be potentiometers using variable resistors, stroke sensors that detect the stroke amounts of the corresponding hydraulic cylinders, rotary encoders that detect the rotation angles around the coupling pins, or the like. The boom angle sensor S1, the arm angle sensor S2, and the bucket angle sensor S3 constitute an attitude sensor that detects the attitude of the excavation attachment.

The upper turning body 3 is provided with a cabin 10 as an operator's cab and a power source such as an engine 11. Further, a body inclination sensor S4, a turning angle sensor S5, and an imaging device S6 are attached to the upper turning body 3. A communication device T1 and a positioning device PS are attached to the upper turning body 3.

The body inclination sensor S4 is configured to detect the inclination of the upper turning body 3 with respect to a predetermined plane. In the present embodiment, the body inclination sensor S4 is an accelerometer that detects an inclination angle around the front-rear axis and an inclination angle around the left-right axis of the upper turning body 3 with respect to the horizontal plane. The longitudinal axis and the lateral axis of the upper turning body 3 are, for example, orthogonal to each other and pass through the shovel center point which is one point on the turning axis of the shovel 100.

The turning angle sensor S5 is configured to detect a turning angular velocity of the upper turning body 3. In the present embodiment, the turning angle sensor S5 is a gyro sensor. The turning angle sensor S5 may be a resolver, a rotary encoder, or the like. The turning angle sensor S5 may detect a turning velocity. The turning velocity may be calculated from the turning angular velocity.

Note that, when the body inclination sensor S4 includes a gyro sensor, a six axis sensor, an IMU, or the like capable of detecting angular velocities about three axes, the turning state (for example, turning angular velocity) of the upper turning body 3 may be detected based on the detection signal of the body inclination sensor S4. In this case, the turning angle sensor S5 may be omitted.

The imaging device S6 is an example of a space recognition device and is configured to acquire an image of the periphery of the shovel 100. In the present embodiment, the imaging device S6 includes a front camera S6F that images a space in front of the shovel 100, a left camera S6L that images a space on the left side of the shovel 100, a right camera S6R that images a space on the right side of the shovel 100, and a rear camera S6B that images a space behind the shovel 100.

The imaging device S6 is, for example, a monocular camera having an imaging device such as a CCD or a CMOS, and outputs a captured image to the display device D3 via the controller 30.

The input device D2 receives an operation input from the user and outputs the operation input to the controller 30. The input device D2 includes any hardware operation unit such as a touch panel, a touch pad, a button, a toggle, and a rotary knob. The input device D2 may include a software operation unit operable through the hardware operation unit, such as a virtual button icon on an operation screen displayed on the display device D3 or the like.

As illustrated in FIG. 2, the front camera S6F is attached to, for example, the roof of the cabin 10. The left camera S6L is attached to a left end of the upper surface of the upper turning body 3. The right camera S6R is attached to a right end of the upper surface of the upper turning body 3. The rear camera S6B is attached to a rear end of the upper surface of the upper turning body 3.

The front camera S6F, the rear camera S6B, the left camera S6L, and the right camera S6R are all attached to the upper turning body 3 such that the optical axes thereof are directed obliquely downward and a part of the upper turning body 3 is included in the imaging range. Therefore, the imaging range of each of the front camera S6F, the rear camera S6B, the left camera S6L, and the right camera S6R has, for example, a viewing angle of approximately 180 degrees in a top view. In the example of FIG. 2, an imaging range AF represents an example of an imaging range of the front camera S6F, an imaging range AB represents an example of an imaging range of the rear camera S6B, an imaging range AL represents an example of an imaging range of the left camera S6L, and an imaging range AR represents an example of an imaging range of the right camera S6R. The four monocular cameras are preferably attached to the upper turning body 3 so as not to protrude from the upper surface of the upper turning body 3 as illustrated in FIG. 2.

In the present embodiment, the imaging device S6 is provided in the above-described arrangement, and thus it is possible to capture an image of an object present around the shovel 100.

The positioning device PS is configured to acquire information on the position of the shovel 100. In the present embodiment, the positioning device PS is configured to measure the position and orientation of the shovel 100. Specifically, the positioning device PS is a GNSS receiver incorporating an electronic compass, measures the latitude, longitude, and altitude of the current position of the shovel 100, and measures the orientation of the shovel 100.

Figure 3:
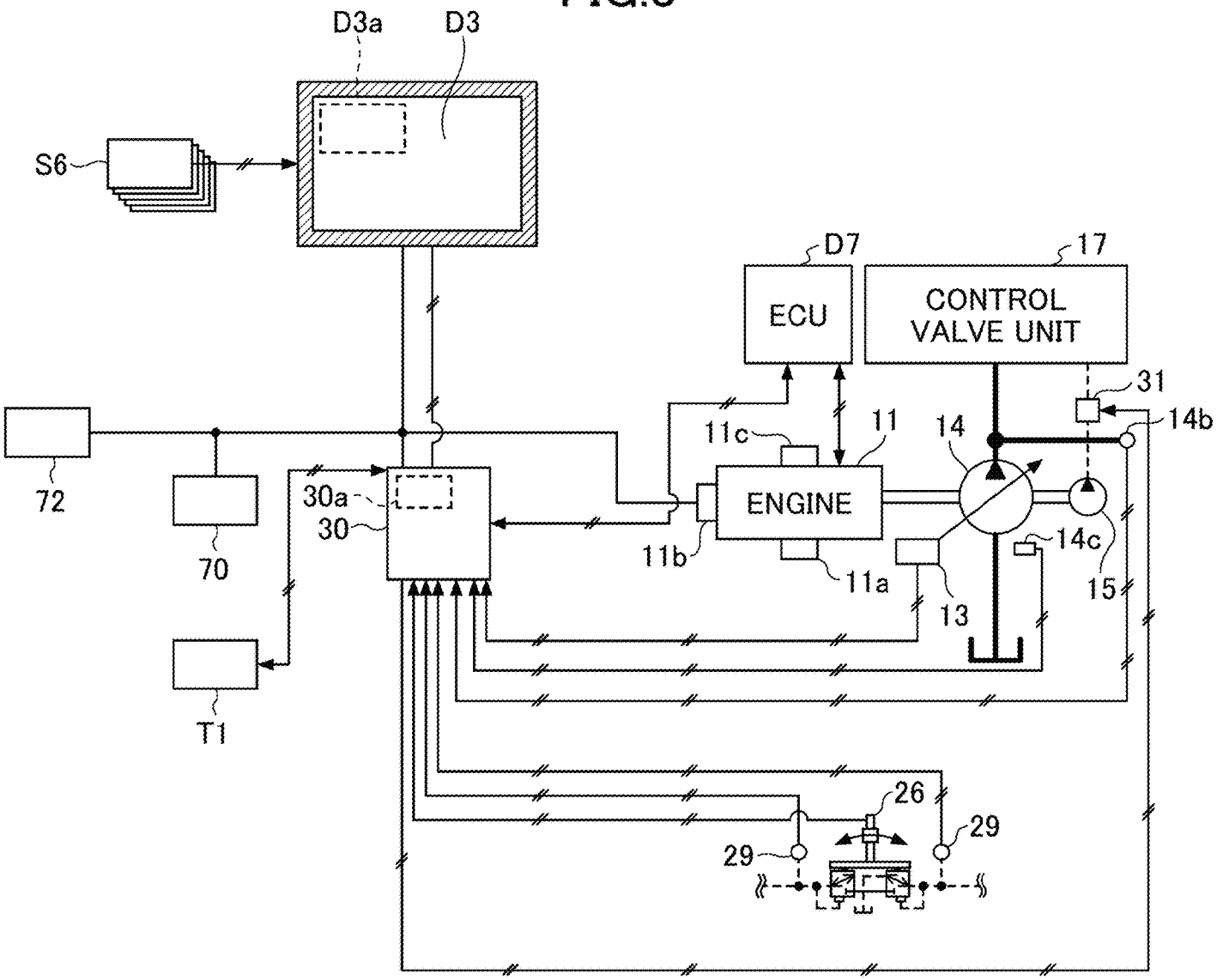
FIG. 3 is a diagram illustrating a configuration example of a drive control system of the shovel according to the embodiment.

FIG. 3 is a diagram illustrating a configuration example of a drive control system of the shovel 100 of FIG. 1. In FIG. 3, the mechanical power transmission system is indicated by a double line, the hydraulic oil line is indicated by a thick solid line, the pilot line is indicated by a broken line, and the electric drive-control system is indicated by a thin solid line.

The engine 11 is a power source of the shovel 100. In the present embodiment, the engine 11 is a diesel engine that employs isochronous control for maintaining the engine speed constant regardless of an increase or decrease in the engine load. The fuel injection amount, the fuel injection timing, the boost pressure, and the like in the engine 11 are controlled by an engine controller unit (ECU) D7.

A rotary shaft of the engine 11 is connected to respective rotary shafts of a main pump 14 and a pilot pump 15 as hydraulic pumps. A control valve unit 17 is connected to the main pump 14 via a hydraulic oil line.

The control valve unit 17 is a hydraulic control device that controls a hydraulic system of the shovel 100. Hydraulic actuators such as the left and right traveling hydraulic motors, the boom cylinder 7, the arm cylinder 8, the bucket cylinder 9, and the turning hydraulic motor are connected to the control valve unit 17 via hydraulic oil lines. The turning hydraulic motor may be a turning motor generator.

FIG. 3 illustrates the connection between the controller 30 and the display device D3. In the present embodiment, the display device D3 is connected to the controller 30. The display device D3 and the controller 30 may be connected to each other via a communication network such as a CAN. In this embodiment, an example in which one display device D3 is provided will be described, but the number of display devices provided in the cabin 10 is not restricted, and a plurality of display devices may be provided.

The display device D3 includes a control unit D3*a* that generates an image. In the present embodiment, the control unit D3*a* generates a camera image for display based on an output of a camera as the imaging device S6. The imaging device S6 is connected to the display device D3 via, for example, a dedicated line.

The control unit D3*a* generates an image for display based on the output of the controller 30. In the present embodiment, the control unit D3*a* converts various kinds of information output by the controller 30 into an image signal. The information output by the controller 30 includes, for example, data indicating the temperature of engine cooling water, data indicating the temperature of hydraulic oil, data indicating the remaining amount of fuel, data indicating the remaining amount of urea water, data indicating the position of a work site of the bucket 6, data indicating the orientation of the slope of the work target, data indicating the orientation of the shovel 100, data indicating the operation direction for causing the shovel 100 to face the slope, and the like.

The control unit D3*a* may be implemented as a function of the controller 30, not as a function of the display device D3. In this case, the imaging device S6 is connected to the controller 30 instead of the display device D3.

The display device D3 operates by receiving power supply from a storage battery 70. The storage battery 70 is charged with electric power generated by an alternator 11*a* (power generator) of the engine 11. The power of the storage battery 70 is supplied to the controller 30, the display device D3, and also to the electrical component 72 of the shovel 100. An engine starter 11*b* of the engine 11 is driven by electric power from the storage battery 70 to start the engine 11.

The engine 11 is controlled by an engine controller unit D7. The engine controller unit D7 constantly transmits various information indicating the state of the engine 11 to the controller 30. The various kinds of information indicating the state of the engine 11 are examples of the operation information of the shovel 100, and include, for example, information indicating the coolant temperature detected by the coolant temperature sensor 11*c* as the operation information acquiring unit. The controller 30 stores the information in a temporary storage unit (memory) 30*a*, and can transmit the information to the display device D3 when necessary.

Various kinds of information are supplied to the controller 30 as operation information of the shovel 100 as described below, and are stored in the temporary storage unit 30*a* of the controller 30.

For example, data indicating the swash plate tilting angle is supplied from a regulator 13 of the main pump 14, which is a variable displacement hydraulic pump, to the controller 30. The controller 30 is also supplied with a signal indicative of the delivery rate of the main pump 14 from a discharge pressure sensor 14*b*. These pieces of information are stored in the temporary storage unit 30*a*. An oil temperature sensor 14*c* is provided in a pipe between the main pump 14 and a tank in which the hydraulic oil sucked by the main pump 14 is stored, and the oil temperature sensor 14*c* supplies information indicating the temperature of the hydraulic oil flowing through the pipe to the controller 30. The regulator 13, the discharge pressure sensor 14*b*, and the oil temperature sensor 14*c* are examples of an operation-information acquiring unit.

An operation device 26 is provided near the operator's seat of the cabin 10 and is used by the operator to operate various driven elements. Specifically, the operation device 26 is used by the operator to operate hydraulic actuators such as the left and right traveling hydraulic motors, the boom cylinder 7, the arm cylinder 8, the bucket cylinder 9, and the turning hydraulic motor, and as a result, the operator can operate driven elements to be driven by the hydraulic actuators. The operation device 26 includes a pedal device and a lever device for operating the respective driven elements.

The operation sensor 29 is configured to detect the content of an operation performed by the operator using the operation device 26. In the present embodiment, the operation sensor 29 detects the operation direction and the operation amount of the operation device 26 corresponding to each of the hydraulic actuators, and outputs an electric signal (hereinafter, also referred to as an operation signal) corresponding to the detected value to the controller 30. In the present embodiment, the controller 30 controls the opening area of a proportional valve 31 in accordance with the output of the operation sensor 29. The controller 30 supplies the hydraulic oil discharged from the pilot pump 15 to the pilot port of the corresponding control valve in the control valve unit 17. The pressure of the hydraulic oil supplied to each of the pilot ports (pilot pressure) is, in principle, a pressure corresponding to the operation direction and the operation amount of the operation device 26 corresponding to each of the hydraulic actuators. In this way, the operation device 26 is configured to be able to supply the hydraulic oil discharged by the pilot pump 15 to the pilot port of the corresponding control valve in the control valve unit 17. Thus, the hydraulic actuator can be driven.

Further, the direction switching valve that is built in the control valve unit 17 and drives each hydraulic actuator may be an electromagnetic solenoid type. In this case, the operation signal output from the operation device 26 may be directly input to the control valve unit 17 (that is, to the electromagnetic solenoid type direction switching valve).

The operation device 26 may be a hydraulic pilot type. Specifically, the operation device 26 outputs a pilot pressure corresponding to the operation content to the pilot line on the secondary side by using the hydraulic oil supplied from the pilot pump 15 through the pilot line. The pilot line on the secondary side is connected to the control valve unit 17. Thus, the pilot pressure corresponding to the operation content related to various driven elements (hydraulic actuators) in the operation device 26 can be input to the control valve unit 17. Therefore, the control valve unit 17 can drive each hydraulic actuator in accordance with the operation content of the operation device 26 by the operator or the like. In this case, an operation sensor 29 capable of acquiring information on an operation state of the operation device 26 is provided, and an output of the operation sensor 29 is incorporated into the controller 30. Thus, the controller 30 can identify the operation state of the operation device 26. The operation sensor 29 is, for example, a pressure sensor that acquires information related to a pilot pressure (operation pressure) of a pilot line on the secondary side of the operation device 26.

Further, a part or all of the hydraulic actuators may be replaced with electric actuators. In this case, for example, the controller 30 may output an operation command corresponding to the operation content of the operation device 26 or the content of the remote control defined by the remote control signal to the electric actuator or a driver or the like that drives the electric actuator. Further, the electric actuator may be configured to be operable by the operation device 26 by inputting an operation signal from the operation device 26 to the electric actuator, the driver, or the like.

Furthermore, when the shovel 100 is exclusively remotely operated or when the shovel 100 is exclusively operated using a fully automatic driving function, the operation device 26 may be omitted.

The proportional valve 31 functions as a control valve for machine control, and is provided for each driven element (hydraulic actuator) to be operated by the operation device 26 and for each operation direction of the driven element (hydraulic actuator) (for example, the raising direction and the lowering direction of the boom 4). For example, two proportional valves 31 are provided for each of the double-acting hydraulic actuators for driving the lower traveling body 1, the upper turning body 3, the boom 4, the arm 5, the bucket 6, and the like. The proportional valve 31 may be provided, for example, in a pilot line between the pilot pump 15 and the control valve unit 17, and may be configured to be able to change the flow passage area (that is, the cross-sectional area through which the hydraulic oil can flow). Accordingly, the proportional valve 31 can output a predetermined pilot pressure to the pilot line on the secondary side by using the hydraulic oil of the pilot pump 15 supplied through the pilot line on the primary side. Therefore, the proportional valve 31 can apply a predetermined pilot pressure corresponding to the operation command from the controller 30 to the control valve unit 17. Therefore, for example, the controller 30 can cause the proportional valve 31 to directly supply the pilot pressure corresponding to the operation content (operation signal) of the operation device 26 to the control valve unit 17, and can implement the operation of the shovel 100 based on the operation of the operator.

The controller 30 may control the proportional valve 31 to implement an automatic operation function of the shovel 100. Specifically, the controller 30 outputs an operation command corresponding to the automatic driving function from the proportional valve 31 to the proportional valve 31. Thus, the controller 30 can implement the operation of the shovel 100 by the automatic operation function.

The controller 30 controls the proportional valve 31 to implement remote control of the shovel 100. To be specific, the controller 30 outputs an operation command corresponding to the content of the operation designated by the operation signal received from the remote control room RC to the proportional valves 31 by the communication device T1. Thus, the controller 30 causes the proportional valve 31 to supply the pilot pressure corresponding to the content of the remote control to the control valve unit 17, and can implement the operation of the shovel 100 based on the remote control by the operator.

In the case where the operation device 26 is of a hydraulic pilot type, a shuttle valve may be provided in a pilot line between the operation device 26 and the proportional valve 31, and the control valve unit 17. The shuttle valve has two inlet ports and one outlet port, and outputs the hydraulic oil having a higher pilot pressure of the pilot pressures input to the two inlet ports to the outlet port. The shuttle valve is provided for each driven element (hydraulic actuator) to be operated by the operation device 26 and for each operation direction of the driven element (hydraulic actuator), as in the proportional valve 31. For example, two shuttle valves are provided for each double-acting hydraulic actuator for driving the lower traveling body 1, the upper turning body 3, the boom 4, the arm 5, the bucket 6, and the like. One of two inlet ports of the shuttle valve is connected to a pilot line on the secondary side of the operation device 26 (specifically, the above-described lever device or pedal device included in the operation device 26), and the other is connected to a pilot line on the secondary side of the proportional valve 31. The outlet port of the shuttle valve is connected to the pilot port of the corresponding directional control valve of the control valve unit 17 through a pilot line. The corresponding direction switching valve is a direction switching valve that drives a hydraulic actuator that is an operation target of the above-described lever device or pedal device connected to one inlet port of the shuttle valve. Therefore, each of these shuttle valves can apply the higher one of the pilot pressures of the pilot line on the secondary side of the operation device 26 and the pilot pressure of the pilot line on the secondary side of the proportional valve 31 to the pilot port of the corresponding direction switching valve. That is, the controller 30 can control the corresponding direction switching valve without depending on the operation of the operation device 26 by the operator by outputting the pilot pressure higher than the pilot pressure on the secondary side of t the operation device 26 from the proportional valve 31. Therefore, the controller 30 can control the operation of the driven elements (the lower traveling body 1, the upper turning body 3, the boom 4, the arm 5, and the bucket 6) regardless of the operation state of the operator on the operation device 26, and can implement the automatic operation function and the remote control function.

In addition, in a case where the operation device 26 is a hydraulic pilot type, in addition to the shuttle valve, a pressure reducing valve may be provided in a pilot line between the operation device 26 and the shuttle valve. The pressure reducing valve is configured to be operated in response to a control signal input from the controller 30, for example, and to be capable of changing the flow passage area thereof. Thus, the controller 30 can forcibly reduce the pilot pressure output from the operation device 26 when the operation device 26 is operated by the operator. Therefore, even when the operation device 26 is operated, the controller 30 can forcibly inhibit or stop the operation of the hydraulic actuator corresponding to the operation of the operation device 26. Further, for example, even when the operation device 26 is operated, the controller 30 can reduce the pilot pressure output from the operation device 26 by the pressure reducing valve to be lower than the pilot pressure output from the proportional valve 31. Therefore, the controller 30 can reliably apply a desired pilot pressure to the pilot port of the direction switching valve in the control valve unit 17, for example, regardless of the operation content of the operation device 26 by controlling the proportional valve 31 and the pressure reducing valve. Therefore, the controller 30 can more appropriately implement the automatic operation function and the remote control function of the shovel 100 by controlling the pressure reducing valve in addition to the proportional valve 31, for example.

The communication system of the shovel 100 according to the present embodiment includes the communication device T1.

The communication device T1 is connected to an external communication line and communicates with a device provided separately from the shovel 100. The device provided separately from the shovel 100 may include a portable terminal device (portable terminal) brought into the cabin 10 by the user of the shovel 100, in addition to the device outside the shovel 100. The communication device T1 may include a mobile communication module conforming to a standard such as 4G (4th Generation) or 5G (5th Generation). The communication device T1 may include, for example, a satellite communications module. The communication device T1 may include, for example, a Wi-Fi communication module or a Bluetooth (Registered Trademark) communication module. In addition, when there are a plurality of connectable communication lines, the communication device T1 may include a plurality of communication devices T1 according to the type of communication line.

For example, the communication device T1 communicates with an external device such as a remote control room in the work site through a local communication line constructed in the work site. The local communication line is, for example, a mobile communication line by a local 5G (so-called local 5G) constructed at the work site or a local network by WiFi.

The communication device T1 is configured to transmit and receive information to and from a communication device installed in the remote control room through a communication line of a wide area including the work site, that is, a wide area network.

In the present embodiment, a case will be described in which the engine 11 is used as a drive source, and the hydraulic pump is operated by the drive force generated by the engine 11, thereby performing the operation of the attachment AT, the turning operation of the upper turning body 3, and the traveling. However, in the present embodiment, the drive source is not limited to the engine 11, and a motor may be used as the drive source. That is, the control described in the present embodiment may be applied to a so-called electric shovel in which a motor serving as a drive source is driven by electric power supplied from a battery, or may be applied to a shovel in which a plurality of drive sources are mounted.

Outline of Process to be Performed by Controller

The controller 30 according to the present embodiment displays information regarding a position of a person detected from captured image information captured by the imaging device S6. Therefore, the controller 30 according to the present embodiment performs a process of detecting whether or not a person is present around the shovel 100 using the captured image information captured by the imaging device S6.

However, there is a situation in which a person cannot be detected from the captured image information even though the person is present around the shovel 100. For example, there is a situation in which a person is too close to the shovel 100, and the person is not present in the imaging range of the imaging device S6, and thus the person cannot be detected from the captured image information. Further, even in a situation where a person is present in the imaging range of the imaging device S6, there is a situation where the person does not appear to be captured because of halation caused by light reflection, the setting sun, or the like. Further, there is a situation in which, although a person is present in the imaging range of the imaging device S6, the person cannot be seen as if the person is captured because the light amount is small and the image is blackened.

In such a situation, a person is not detected, but it is highly likely that the person is present. Therefore, when a person is no longer detected by the imaging device S6 (an example of a space recognition device), the controller 30 according to the present embodiment continues to display the position of the person who is no longer detected in a case where a predetermined condition is satisfied.

Block Configuration of Controller of Shovel

Figure 4:
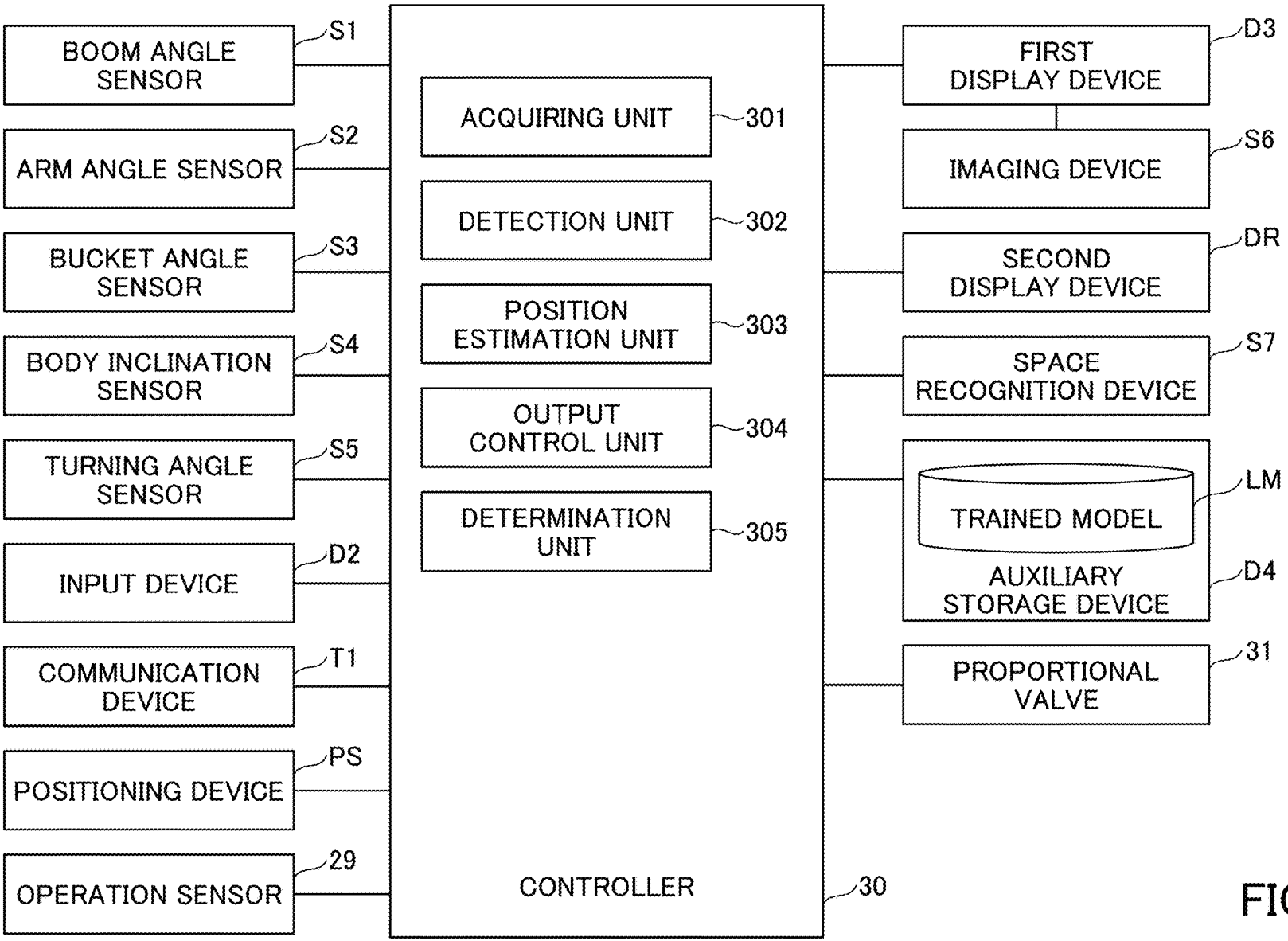
FIG. 4 is a functional block diagram illustrating a configuration example of a controller of the shovel according to the embodiment.

FIG. 4 is a functional block diagram illustrating a configuration example of the controller 30 of the shovel 100 according to the present embodiment. In the example illustrated in FIG. 4, a block configuration of the controller 30 of the shovel 100 is illustrated.

The controller 30 receives information output from the boom angle sensor S1, the arm angle sensor S2, the bucket angle sensor S3, the body inclination sensor S4, the turning angle sensor S5, the imaging device S6, the input device D2, the communication device T1, the positioning device PS, and the like. Then, various calculations are performed based on the received information and the information stored in the auxiliary storage device D4, and the calculation results are output to the display device D3, the proportional valve 31, and the like.

Note that, in the present embodiment, an example in which the controller 30 controls the shovel 100 will be described, but a part of the functions of the controller 30 may be implemented by another controller (control device). That is, the function of the controller 30 may be implemented by a plurality of controllers mounted on the shovel 100 in a distributed manner.

The shovel 100 operates an actuator (for example, a hydraulic actuator) in response to an operation of an operator boarding the cabin 10, and drives operation elements (hereinafter, "driven elements") such as the lower traveling body 1, the upper turning body 3, the boom 4, the arm 5, and the bucket 6.

Further, the shovel 100 may be configured to be remotely operated from the outside of the shovel 100 instead of or in addition to being configured to be operable by the operator of the cabin 10. When the shovel 100 is remotely operated, the inside of the cabin 10 may be unmanned.

The auxiliary storage device D4 stores a trained model LM.

When the captured image information captured by the imaging device S6 is input from the input layer, the trained model LM outputs image information indicating an image in which a person represented in the captured image information is surrounded by a rectangle. In the present embodiment, an example of an output mode of the trained model LM will be described, but the present embodiment is not limited to the mode of outputting image information in which a person is surrounded by a rectangle, and may be any output mode insofar as a detected result of a person represented in captured image information may be indicated.

As the machine learning used for generating the trained model LM, for example, a neural network may be applied, and specifically, deep learning which is machine learning using a deep neural network (DNN) may be applied. As the deep learning, for example, a convolutional neural network, a recurrent neural networks (RNN), or a long short-term memory (LSTM) may be applied.

The trained model LM is generated by performing machine learning based on a training data set generated in advance in an information processing apparatus (not illustrated).

Specifically, the trained model LM is generated by machine learning based on captured image information in which a person is represented and image information in which the person represented in the captured image information is surrounded by a rectangle, which are included in the training data set.

The trained model LM may be updated by causing the existing trained model LM to be additionally trained with a new training data set.

The controller 30 includes an acquiring unit 301, a detection unit 302, a position estimation unit 303, an output control unit 304, and a determination unit 305.

The acquiring unit 301 acquires various kinds of information from various sensors. For example, the acquiring unit 301 acquires captured image information captured by the imaging device S6 (the front camera S6F, the left camera S6L, the right camera S6R, and the rear camera S6B).

The acquiring unit 301 acquires detection information detected by each of the boom angle sensor S1, the arm angle sensor S2, the bucket angle sensor S3, the body inclination sensor S4, and the turning angle sensor S5. The acquiring unit 301 acquires the position and orientation of the shovel 100 from the positioning device PS.

The detection unit 302 performs a process of detecting a person present around the shovel 100 from the captured image information acquired by the acquiring unit 301. The detection unit 302 according to the present embodiment inputs the captured image information to the trained model LM, and thereby receives image information in which the person represented in the captured image information is surrounded by a rectangle from the trained model LM. In the present embodiment, a method of detecting a person using the trained model LM will be described. However, the present embodiment does not limit the method of detecting a person, and any of well-known methods may be used. For example, it may be determined whether or not the feature extracted from the captured image information is similar to a predetermined feature indicating a person by a predetermined value or more.

When there is an area surrounded by a rectangle in the image information received from the detection unit 302, the position estimation unit 303 estimates the position of the person in the real space, for example, the direction in which and the distance to which the person is present with respect to the shovel 100, from the position coordinates at which the rectangle is represented in the image information. A specific estimation method may be a conventionally used method, and thus the description thereof will be omitted.

The position estimation unit 303 according to the present embodiment uses a method of estimating the direction in which and the distance to which a person is present based on the position and size of a rectangle in which the person appears in the image information, but another method may be used. For example, a method in which the trained model LM outputs the direction in which and the distance to which the person is present may be used.

Note that the present embodiment is not limited to the method of detecting a person and estimating the position of the person by the controller 30, and for example, the detection and the estimation may be performed in the imaging device S6 or an external cloud service may be used.

The output control unit 304 outputs the turning angle, image information on an area in which a person is captured surrounded by a rectangle, position coordinates information of a person present around the shovel 100 (information indicating the direction in which and the distance to which the detected person is present), and detection results of the various sensors to the control unit D3*a* of the display device D3. Thus, the display device D3 displays a screen illustrating the surroundings of the shovel 100.

Figure 5:
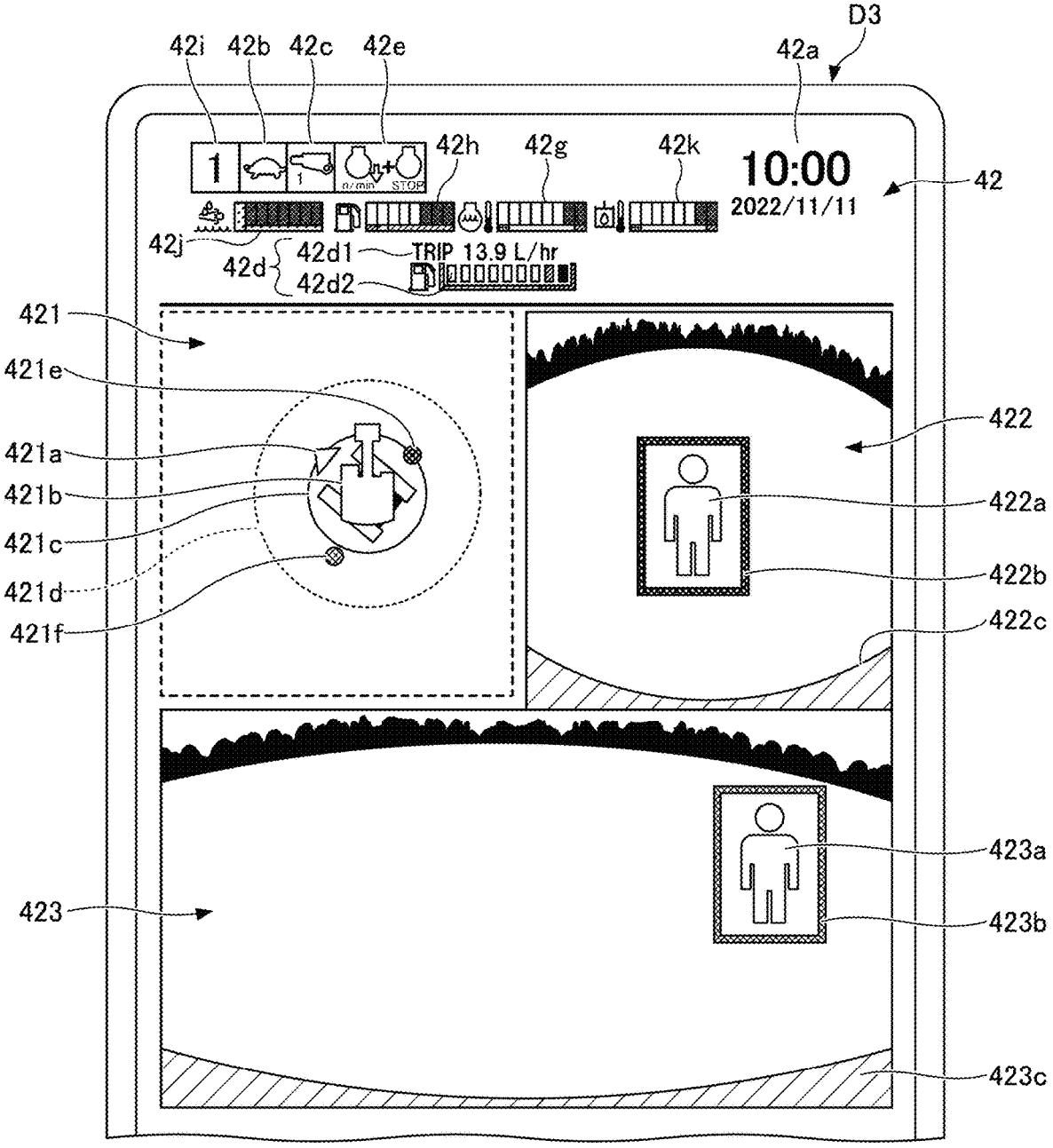
FIG. 5 is a diagram illustrating an example of a display screen displayed by the display device according to the embodiment.

Next, an example of a display screen displayed on the display device D3 will be described with reference to FIG. 5. FIG. 5 is a diagram illustrating an example of a display screen 42 displayed by the display device D3 according to the present embodiment.

The control unit D3*a* according to the present embodiment generates a display screen based on the image information input from the imaging device S6 and various kinds of information received from the controller 30. The information received from the controller 30 includes the turning angle, image information in which an area in which a person is photographed is surrounded by a rectangle, position coordinates information of a person present around the shovel (information indicating a direction and a distance in which the detected person is present), and detection results of various sensors.

The display screen 42 displays, under the control of the control unit D3*a*, a date and time display area 42*a*, a traveling mode display area 42*b*, an attachment display area 42*c*, a fuel consumption display area 42*d*, an engine control state display area 42*e*, an engine operating time display area, a coolant temperature display area 42*g*, a remaining fuel amount display area 42*h*, a rotational speed level display area 42*i*, a remaining urea-water amount display area 42*j*, a hydraulic oil temperature display area 42*k*, a human detection map display area 421, a first image display area 422, and a second image display area 423. The display screen 42 may include other display areas.

The traveling mode display area 42*b*, the attachment display area 42*c*, the engine control state display area 42*e*, and the rotational speed level display area 42*i* are areas for displaying setting state information which is information regarding the setting state of the shovel 100. The fuel consumption display area 42*d*, the engine operating time display area, the coolant temperature display area 42*g*, the remaining fuel amount display area 42*h*, the remaining urea-water amount display area 42*j*, and the hydraulic oil temperature display area 42*k* are areas for displaying operating state information, which is information indicating the operating state of the shovel 100, based on the detection results of the various sensors.

The date and time display area 42*a* is an area for displaying the current date and time. The traveling mode display area 42*b* is an area for displaying the current traveling mode. The attachment display area 42*c* is an area for displaying an image representing the attachment currently attached. The fuel consumption display area 42*d* is an area for displaying fuel consumption information calculated by the controller 30. The fuel consumption display area 42*d* includes a mean fuel consumption display area 42*d*1 for displaying a lifetime mean fuel consumption or an interval mean fuel consumption, and an instantaneous fuel consumption display area 42*d*2 for displaying an instantaneous fuel consumption.

The engine control state display area 42*e* is an area for displaying the control state of the engine 11. The temperature display area 42*g* is an area for coolant displaying the current temperature state of the engine coolant. The remaining fuel amount display area 42*h* is an area that displays the remaining amount of fuel stored in the fuel tank.

The rotational speed level display area 42*i* is an area in which the current level set by a dial 32 (not illustrated) is displayed as an image. In the rotational speed level display area 42*i*, a number indicating the selected level is displayed. The number "1" displayed in the rotational speed level display area 42*i* indicates that the selected rotational speed level is the "first level." The number "n" displayed in the rotational speed level display area 42*i* indicates that the selected rotational speed level is "the nth level." Note that "n" is a natural number. When the user rotates the dial 32, the number displayed in the rotational speed level display area 42*i* changes.

The remaining urea-water amount display area 42*j* is an area for displaying the remaining amount of the urea-water stored in the urea-water tank as an image. The hydraulic oil temperature display area 42*k* is an area for displaying the temperature state of the hydraulic oil in the hydraulic oil tank.

The human detection map display area 421 is an area for displaying information indicating a positional relationship between the shovel 100 and a human (person) detected around the shovel 100.

The human detection map display area (an example of position information) 421 is a display area of a map in which a real space around the shovel 100 is represented at a predetermined scale. In the human detection map display area 421, a shovel icon 421*b* indicating the presence of the shovel 100 is arranged at the center of the area.

In the human detection map display area 421, in addition to the shovel icon 421*b* representing the shovel 100, an icon (direction display icon 421*a* in the example of FIG. 5) representing direction in which the shovel 100 can travel, and icons (human detection icons 421*e* and 421*f* in the example of FIG. 5) representing persons detected from the surroundings of the shovel 100 are simultaneously displayed. In the human detection map display area 421, an area (in other words, a background) other than the shovel icon 421*b*, the direction display icon 421*a*, and the human detection icons 421*e* and 421*f* may be an area represented by a single color (for example, black).

The shovel icon 421*b* is an icon obtained by combining an image indicating the upper turning body 3 and an image indicating the lower traveling body 1 in accordance with the positional relationship between the upper turning body 3 and the lower traveling body 1 based on the turning angle.

The direction display icon 421*a* indicates the direction in which the shovel 100 travels when the travel lever is tilted forward, by a triangular shape. Note that the present embodiment illustrates an example of the icon representing the direction in which the shovel 100 travels when the travel lever is tilted forward, and the icon may have any shape as long as the shape represents the direction in which the shovel 100 can travel.

The human detection icons (an example of display information) 421*e* and 421*f* are icons indicating the positions where humans are present, which are estimated by the position estimation unit 303. To be specific, the human detection icons 421*e* and 421*f* are arranged based on the directions in which and the distances to which the persons are present with respect to the shovel 100, which are estimated by the position estimation unit 303. To be specific, the human detection icons 421*e* and 421*f* are arranged at positions obtained by multiplying the directions in which and the distances to which the detected persons are present by a predetermined scaling factor with reference to the shovel 100.

In this way, the positional relationship between the shovel icon 421*b* and the human detection icons 421*e* and 421*f* displayed in the human detection map display area 421 corresponds to the positional relationship between the shovel 100 in the real space and the humans present around the shovel 100.

In the present embodiment, an example in which the human detection map display area 421 is used as the position information representing the positional relationship between the person detected by the imaging device S6 and the shovel 100 as a diagram will be described. However, in the present embodiment, the position information representing the relationship between the positions of the person detected by the imaging device S6 and the shovel 100 is not limited to the human detection map display area 421. For example, position information representing a positional relationship by superimposing the positions of the person and the shovel 100 detected by the imaging device S6 on the bird's-eye view image information based on the captured image information captured by the imaging device S6 may be used. As described above, the position information may be information that can recognize the positional relationship between the shovel and the person.

In the human detection map display area 421 according to the present embodiment, since the display of the object other than the person present around the shovel 100 is prevented, the operator can recognize the current situation and the direction in which the shovel 100 can travel and the positional relationship with the person present around the shovel 100 by referring to the human detection map display area 421.

Further, the operator can estimate how the positional relationship between the shovel 100 and the person present in the surroundings changes when the shovel 100 is moved by referring to the human detection map display area 421. Further, since the display of the shovel and an object other than the person is inhibited in the human detection map display area 421, it is possible to inhibit the operator from drawing attention to other objects and forgetting the presence of the person. Therefore, the safety can be improved.

In addition, in the human detection map display area 421, a first circular area 421*c* and a second circular area 421*d* which are determined according to distances from the shovel 100 are displayed with the shovel 100 as a reference.

The first circular area 421*c* and the second circular area 421*d* illustrated in FIG. 5 are represented as circles for allowing the user to recognize relative distances from the shovel 100 with reference to the shovel icon 421*b*.

The first circular area 421*c* is, for example, information indicating a range within 2 m around the shovel 100. The second circular area 421*d* is, for example, information indicating a range within 4 m around the shovel 100.

The display screen 42 according to the present embodiment can recognize the position of the person with respect to the shovel 100 based on the positional relationship between the first circular area 421*c* and the second circular area 421*d*, and the human detection icons 421*e* and 421*f*.

Furthermore, the control unit D3*a* changes the display mode of the human detection icons 421*e* and 421*f* depending on whether the human detection icons 421*e* and 421*f* are included in the first circular area 421*c* and the second circular area 421*d*.

For example, the human detection icon 421*e* present inside the first circular area 421*c* is displayed in red, for example. The human detection icon 421*f* present outside the first circular area 421*c* and inside the second circular area 421*d* is displayed in yellow, for example. The human detection icon (not illustrated) existing outside the second circular area 421*d* is displayed in green, for example.

The control unit D3*a* according to the present embodiment changes the display mode depending on whether or not the human detection icon is included in the first circular area 421*c* and the second circular area 421*d*. In this way, the display device D3 displays the human detection icons whose colors are changed according to the distances, thereby attracting attention to the operator according to the distances between the shovel 100 and the persons. Therefore, the safety can be improved.

The color of the human detection icon of the present embodiment is merely an example, and there is no limitation to use of color as above. For example, the human detection icon may be displayed in grayscale. The color change of the human detection icon in the present embodiment is an example of the display mode, and the present disclosure is not limited to the color change. For example, the blinking cycle of the human detection icon may be changed, or the contrast or brightness may be changed, depending on whether or not the human detection icon is included in the first circular area 421*c* and the second circular area 421*d*.

On the display screen 42, the human detection map display area 421 is displayed, and image information captured by the imaging device S6 is displayed. The operator can recognize a specific situation around the shovel 100 by checking the image information together with the human detection map display area 421. Therefore, the safety can be improved.

In the display screen 42 illustrated in FIG. 5, the first image display area 422 and the second image display area 423 are areas for displaying image information captured by the imaging device S6, and include an image 423*c* of the counterweight of the upper turning body 3. The first image display area 422 displays a right image. A rear image is displayed in the second image display area 423. The right image is an image illustrating a space on the right side of the shovel 100, and includes an image 422*c* of the right end of the upper surface of the upper turning body 3.

The right image is image information output from the trained model LM, and is image information in which a person represented in the real viewpoint image captured by the right camera S6R is surrounded by a rectangle. The rear image is image information output from the trained model LM, and is image information in which a person represented in the real viewpoint image captured by the rear camera S6B is surrounded by a rectangle.

As a result, a frame 422*b* is displayed surrounding the person 422*a* in the right image in the first image display area 422, and a frame 423*b* is displayed surrounding the person 423*a* in the rear image in the second image display area 423.

The first image display area 422 is displayed on the right side with respect to the human detection map display area 421. The second image display area 423 is displayed below the human detection map display area 421. In the present embodiment, the upper side of the display screen 42 corresponds to the front side of the upper turning body 3. In other words, the second image display area 423 is displayed at a position corresponding to the rear side with respect to the human detection map display area 421. That is, the display screen 42 displays the image information captured by the imaging device S6 in the direction in which the imaging device S6 performs imaging with reference to the human detection map display area 421. In the present embodiment, since the captured image information is displayed in the direction in which the image is captured with reference to the human detection map display area 421, the operator can intuitively recognize the direction in which the image information represents the situation when referring to the image information. Therefore, the safety can be improved.

Note that the present embodiment illustrates an example of the arrangement of image information, and the present disclosure is not limited to this arrangement. For example, the first image display area 422 and the second image display area 423 may be arranged regardless of the direction in which the image is captured.

The control unit D3*a* matches the color of the frame 422*b* of the right image of the first image display area 422 with the color of the human detection icon 421*e*, and matches (an example of "associates") the color of the frame 423*b* of the rear image of the second image display area 423 with the color of the human detection icon 421*f*.

That is, on the display screen 42, the frame indicating the detected person is displayed with respect to the right image and the rear image, and the correspondence relationship between the person indicated by the frame and the human detection icon is displayed in a recognizable manner. Accordingly, the operator can recognize the situation of the person indicated in the human detection map display area 421 by referring to the right image and the rear image. Therefore, the operator can operate the shovel 100 in consideration of the situation of the person present around the shovel 100. Therefore, the safety can be improved. In the present embodiment, the color of the frame is matched with the color of the human detection icon as an example of display for recognizing the correspondence relationship. However, the present embodiment is an example of display for causing the user to recognize the correspondence relationship, and is not limited to the example of matching the color of the frame with the color of the human detection icon. For example, the correspondence relationship may be recognized by a cycle of blinking of the frame and the human detection icon.

As described above, the color of the human detection icon is changed according to the distance from the shovel 100. The color of the human detection icon in the human detection map display area 421 are matched with the colors of the frames displayed in the right image and the rear image. Therefore, the display screen 42 displays the right image and the rear image with the frames displayed in a different color (an example of a display mode) based on the distance between the shovel 100 and the person. In the present embodiment, the colors of the frames displayed in the right image and the rear image are changed according to the distance from the shovel 100, and therefore, the operator can recognize the distance from the shovel 100 when referring to the color of the frame. Therefore, the operator can perform an operation according to the distance, and thus, it is possible to improve safety.

In the present embodiment, the control unit D3*a* displays the display screen 42, and thus the user can identify the situation around the shovel 100.

Returning to FIG. 4, the determination unit 305 compares the direction and the distance of the person estimated from the image information previously received from the trained model LM with the direction and the distance of the person estimated from the image information currently received from the trained model LM, and determines whether or not the person previously detected is no longer detected at the current time.

Then, when determining that the previously detected person is no longer detected at the current time, the determination unit 305 determines whether or not the positional relationship between the detection range in which a person can be detected from the captured image information by the imaging device S6 and the position of the person who is no longer detected satisfies a predetermined condition. The conditions of the present embodiment will be described.

Figure 6:
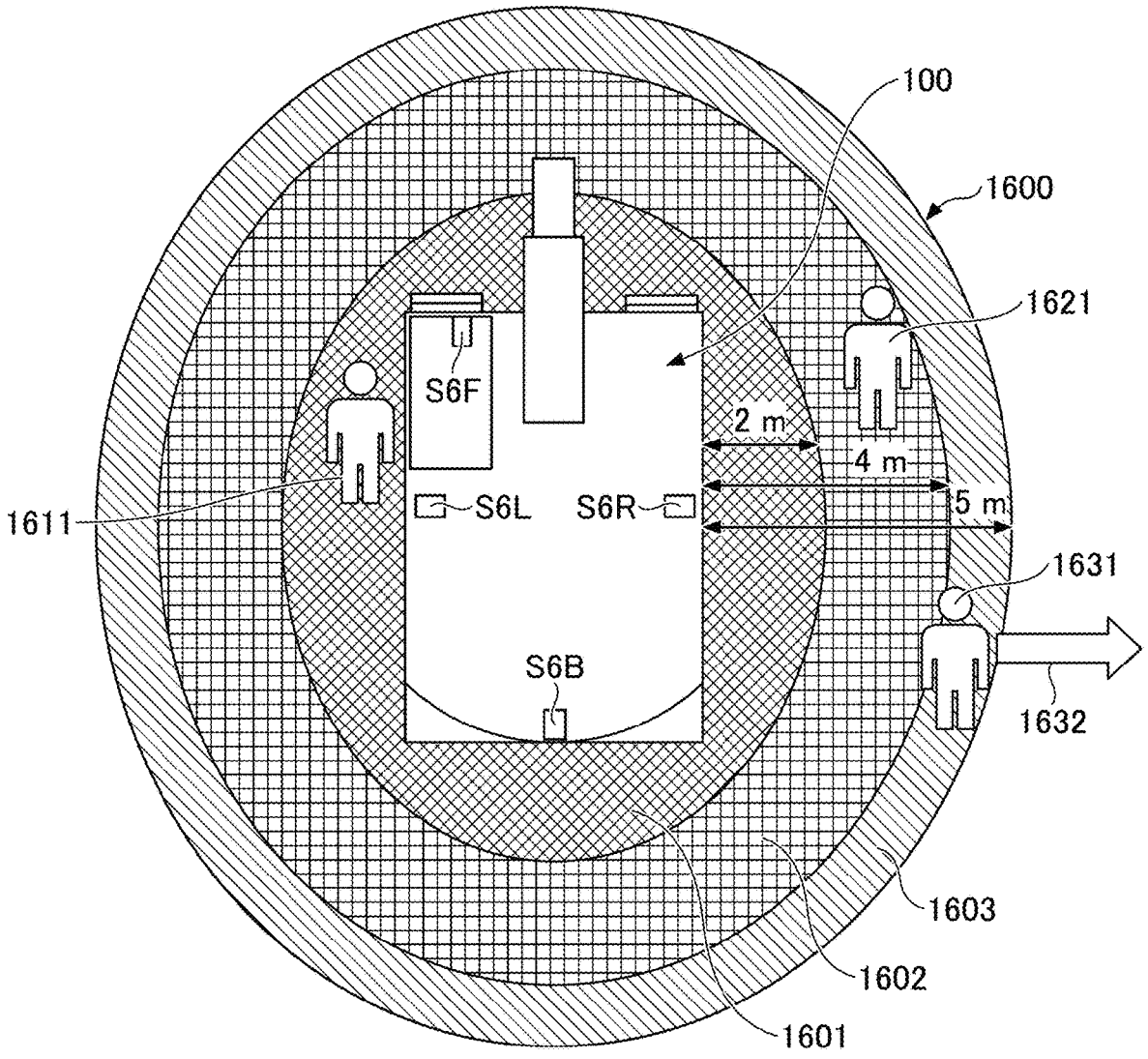
FIG. 6 is a diagram illustrating a method of determining whether or not a person is present around the shovel in accordance with a positional relationship between the shovel and the person in the determination unit according to the embodiment.

FIG. 6 is a diagram illustrating a method of determining whether or not a person is present around the shovel 100 according to the positional relationship between the shovel 100 and the person in the determination unit 305 according to the present embodiment. A detection range 1600 illustrated in FIG. 6 indicates a range in which a person can be detected around the shovel 100 by the front camera S6F, the rear camera S6B, the left camera S6L, and the right camera S6R, with the shovel 100 as the center. In other words, the detection range 1600 is a part of a range obtained by combining the imaging range AF, the imaging range AB, the imaging range AL, and the imaging range AR illustrated in FIG. 2, and is a range in which a person can be detected from the captured image information by the imaging device S6.

In the present embodiment, the detection range 1600 is divided into three areas for the determination by the determination unit 305. In the present embodiment, the detection range 1600 is divided into a first range 1601, a second range 1602, and a third range 1603 from the inner side.

The first range 1601 is a range within the surrounding 2 m of the shovel 100. The second range 1602 is a range outside the first range 1601 and within 4 m around the shovel 100. The third range 1603 is a range outside the second range 1602 and within 5 m around the shovel 100.

In the present embodiment, an example is described in which the first range 1601 corresponds to the first circular area 421*c* of the human detection map display area 421, and the second range 1602 corresponds to the second circular area 421*d* of the human detection map display area 421. However, the division of the detection range 1600 described above is not limited to the method of corresponding to the display of the human detection map display area 421, and the division of the detection range 1600 may be used only for internal processing.

Then, when determining that the person who has been previously detected is no longer detected at the current time, the determination unit 305 causes the determination result to differ depending on which range of the first range 1601 to the third range 1603 the person exists in.

The third range 1603 is the outside of the detection range 1600. For example, when the person 1631 is present in the third range 1603, a person 1631 can immediately move out of the detection range 1600 by moving in the direction of the arrow 1632. Therefore, when the person who has been present in the third range 1603 is no longer detected at the current time, the determination unit 305 can determine that the person has moved to the outside of the detection range 1600. That is, the determination unit 305 can determine that the person is no longer present.

The second range 1602 is neither in the vicinity of the shovel 100 nor in an area outside the detection range 1600. For example, when the person 1621 is present in the second range 1602, it is difficult for the person 1621 to move out of the detection range 1600 without being detected in the first range 1601 or the third range 1603. Therefore, when a person who has been present in the second range 1602 is not detected at the current time, the determination unit 305 determines that the person is still present in the detection range 1600 and the person is not detected at the current time because a detection error has occurred.

The first range 1601 is a range in the vicinity of the shovel 100. For example, when the person 1611 is present in the first range 1601, the person 1611 can move under the lower traveling body 1 or can be stuck to the shovel 100. That is, there is a high possibility that a person is present in the vicinity of the shovel 100 although the person is not present in the detection range 1600. Further, the reason why the person is still present in the detection range 1600, and the person is no longer detected at the current time is that there is a possibility that a detection error has occurred. Therefore, when the person who has been present in the first range 1601 is no longer detected at the current time, the determination unit 305 determines that at least the person is present in the vicinity of the shovel 100.

That is, when the person whose position is represented in the human detection map display area 421 is no longer detected by the imaging device S6, the determination unit 305 determines that the person is present in the vicinity of the shovel 100 in a case where the last detected position of the person is not a position at which the person is able to move from the detection range 1600 to the outside such as the first range 1601 or the second range 1602, or the last detected position of the person is a position at which the person is able to move toward the shovel side from the detection range 1600.

Note that the determination by the determination unit 305 in the present embodiment is an example using a determination condition based on the positional relationship between the detection range in which a person can be detected from the captured image information by the imaging device S6 and the position of a person who is no longer detected, and is not limited to the determination based on the determination condition. For example, the determination unit 305 may determine whether or not the position of the person who is no longer detected is in the vicinity of the boundary of the detection range in which the person can be detected from the captured image information by the imaging device S6. Furthermore, the determination unit 305 may determine whether or not the person has moved out of the detection range in consideration of the moving speed of the person. The predetermined condition for determination is not limited to the determination condition described above, and the predetermined condition may be determined according to a situation regarding the brightness of the work site, the moving speed of the person, the capability of the imaging device S6, the resolution of the captured image information by the imaging device S6, and other implementation conditions.

In the present embodiment, a determination condition based on a positional relationship between a detection range in which a person can be detected from captured image information by the imaging device S6 and a position of a person who is no longer detected is used. Therefore, the determination by the determination unit 305 according to the present embodiment is a determination in consideration of the positional relationship and is not a determination using a new sensor or the like, and thus it is possible to improve the detection accuracy while reducing the cost.

The output control unit 304 outputs the determination result by the determination unit 305 to the control unit D3*a* of the display device D3. When the person whose position is represented in the human detection map display area 421 is no longer detected from the captured image information by the imaging device S6, and the determination unit 305 determines that the person is present in the vicinity of the shovel 100 (an example of a case where the predetermined condition is satisfied), the control unit D3*a* continues to display the position of the person who is no longer detected in the human detection map display area 421.

Figure 7:
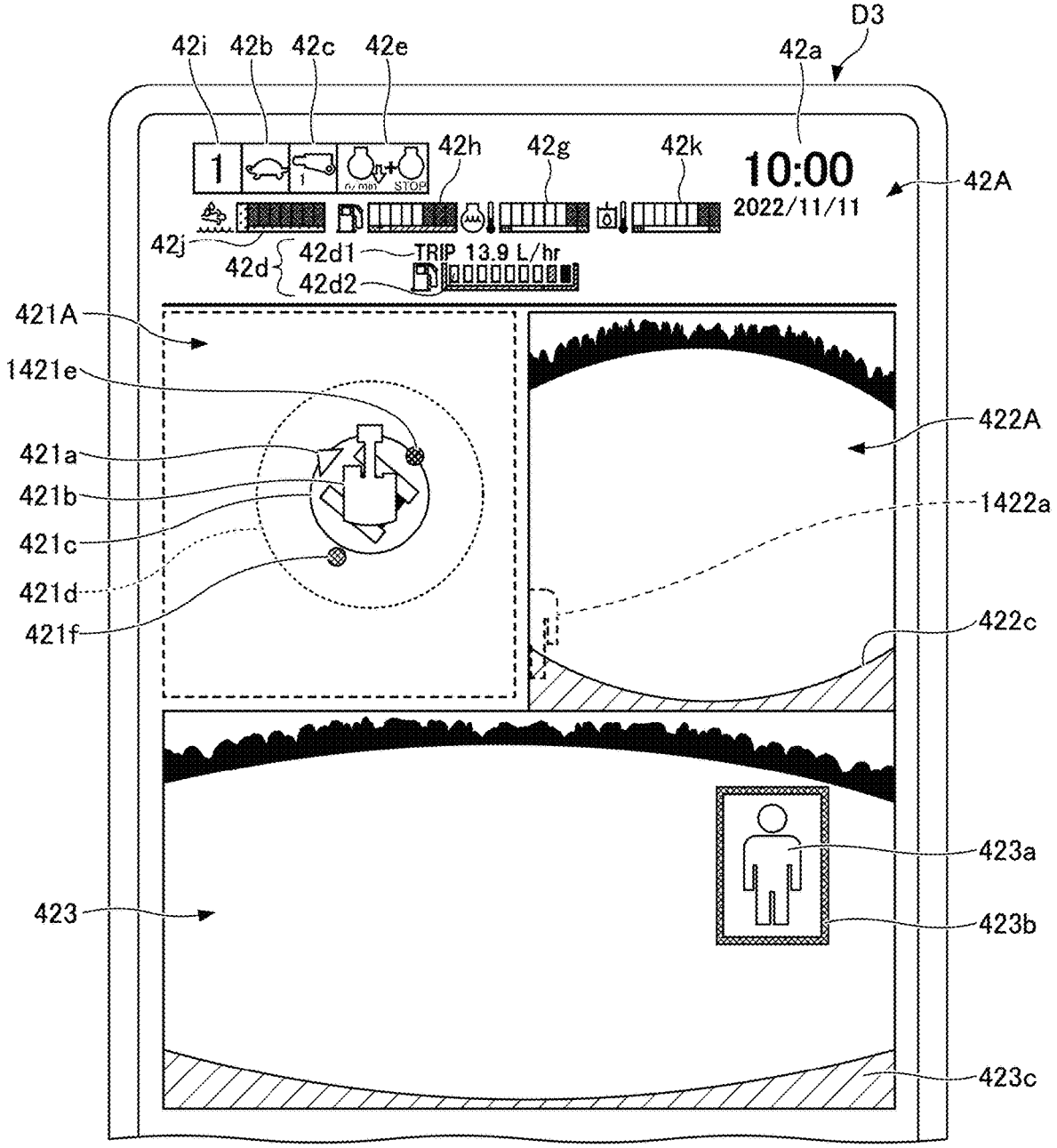
FIG. 7 is a diagram illustrating an example of a display screen displayed by the display device according to the embodiment.

FIG. 7 is a diagram illustrating an example of a display screen 42A displayed by the display device D3 according to the present embodiment. In the display screen 42A illustrated in FIG. 7, the same components as those of the display screen 42 illustrated in FIG. 5 are denoted by the same symbols, and the description thereof will be omitted.

In the display screen 42A illustrated in FIG. 7, the right image displayed in a first image display area 422A is not detected by the trained model LM because a person 1422*a* is moving.

Even when the person is no longer detected in the right image, in other words, even when the display of the frame surrounding the person (an example of an area in which the person is detected) is inhibited in the first image display area 422A, the display device D3 continues to display the human detection icon 1421*e* corresponding to the person 1422*a* in the human detection map display area 421A together with the first image display area 422A.

Therefore, even when the rectangle surrounding the person is not displayed in the first image display area 422A when the user refers to the display screen 42A, the user can estimate that the person is present in the right vicinity of the shovel 100 by referring to the human detection icon 1421*e* displayed in the human detection map display area 421A. As described above, in the present embodiment, the human detection map display area 421A and the first image display area 422A are simultaneously displayed on the display screen 42A.

Then, when the determination unit 305 according to the present embodiment determines that a person is present in the vicinity of the shovel 100, the controller 30 continues to hold the direction in which and the distance to which the person was detected last. Then, the determination unit 305 repeatedly determines whether or not the previously detected person is detected at the current time using the held information.

Then, when the detection unit 302 newly detects a person from the captured image information by the imaging device S6, the determination unit 305 determines that the person who has been previously detected is detected again at the current time.

In this case, the display device D3 moves the human detection icons to positions corresponding to the directions and distances of the newly detected persons without increasing the number of human detection icons displayed in the human detection map display area. Then, the controller 30 deletes the information regarding the direction and the distance detected last, which has been held.

In the controller 30 according to the present embodiment, when the power is turned off, the situation related to detection is initialized once. That is, the controller 30 deletes the information regarding the direction and the distance detected last, which has been held. The initialization process according to the present embodiment may be performed in a case other than the case of turning off the power supply, and may be performed in the case of the turning of the upper turning body 3 or the travel of the lower traveling body 1, for example.

Figure 8:
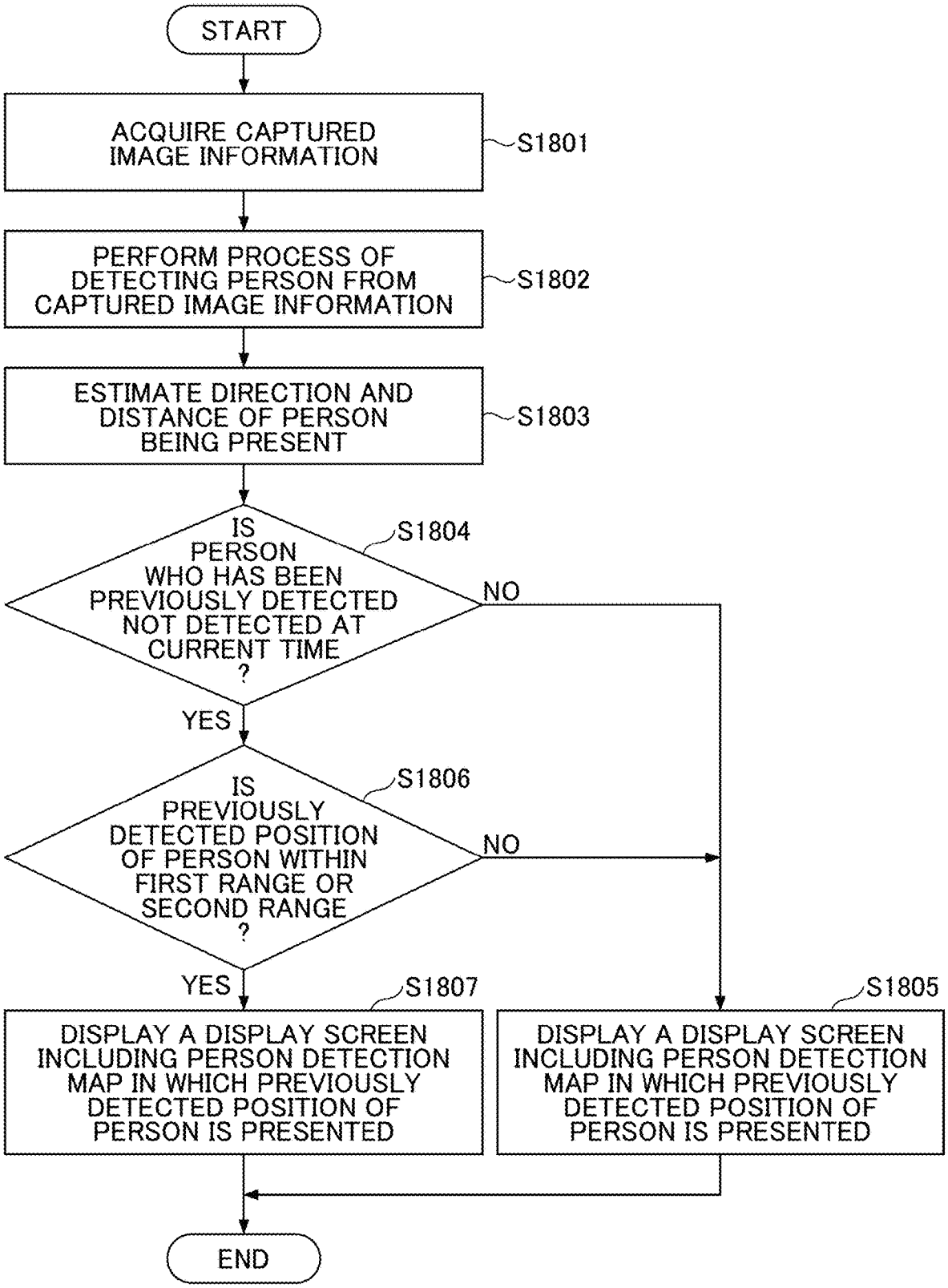
FIG. 8 is a flowchart illustrating a processing procedure the controller and the display device according to the embodiment display a display screen.

Next, a processing procedure executed by the controller 30 and the display device D3 according to the present embodiment will be described. FIG. 8 is a flowchart illustrating a processing procedure until the controller 30 and the display device D3 according to the present embodiment display a display screen. The processing procedure illustrated in the flowchart according to the present embodiment is repeatedly performed at each predetermined cycle.

First, the acquiring unit 301 acquires captured image information captured by the imaging device S6 (S1801).

The detection unit 302 performs a process of detecting a person present around the shovel 100 from the captured image information acquired by the acquiring unit 301 (S1802). In the present embodiment, the detection unit 302 inputs the captured image information to the trained model LM, and receives image information in which the person represented in the captured image information is surrounded by a rectangle from the trained model LM, thereby detecting the person present around the shovel 100.

The position estimation unit 303 estimates the direction and the distance of the person being present with respect to the shovel 100 from the position coordinates of the person (the rectangle) in the captured image information (S1803).

The determination unit 305 compares the direction and distance of the person estimated in the previous step S1803 with the direction and distance of the person estimated in the current step S1803, and determines whether the person who has been previously detected is not detected at the current time (S1804).

When the determination unit 305 determines that the person who has been previously detected is also detected at the current time (S1804: NO), the display device D3 displays the display screen including the human detection map display area in which the position of the detected person is displayed (S1805).

When the determination unit 305 determines that the person who has been previously detected is not detected at the current time (S1804: YES), the determination unit 305 determines whether the position of the person at the time of the previous detection is within the first range or the second range of the detection range (S1806). When the determination unit 305 determines that the position is outside the first range and the second range, in other words, within the third range (S1806: NO), the display device D3 displays the display screen including the human detection map display area in which the position of the detected person is represented (S1805).

On the other hand, when the determination unit 305 determines that the position of the person at the time of the previous detection is within the first range or the second range (S1806: YES), the display device D3 displays the display screen including the human detection map display area in which the human detection icon is represented at the previously detected position of the person (S1807).

In the present embodiment, by performing the above-described control, even when a person is no longer detected from the captured image information, and a predetermined condition is satisfied, the human detection map display an area in which the human detection icon is displayed at the previously detected position of the person. Therefore, even when a detection error occurs and when the person is not included in the imaging range because the person approaches the shovel 100, the operator can recognize that the person is present.

The display device D3 according to the present embodiment has been described with respect to an example in which, when a person who has been previously detected is no longer detected, a display screen including the same human detection map display area as the previous one is displayed. However, the present embodiment does not limit the display mode of the display screen including the human detection map display area, and various display modes may be used.

Figure 9A:
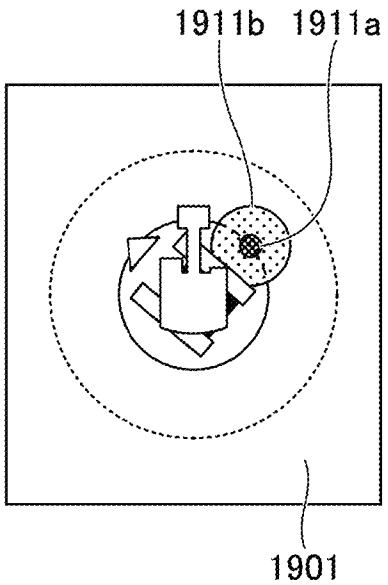
FIG. 9A is a diagram illustrating a modification of a human detection map display area displayed by the display device.
Figure 9B:
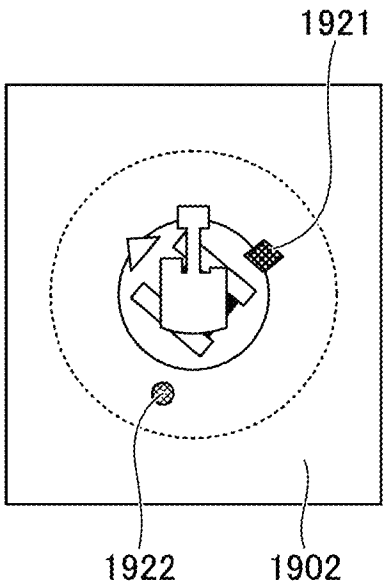
FIG. 9B is a diagram illustrating a modification of the human detection map display area displayed by the display device.
Figure 9C:
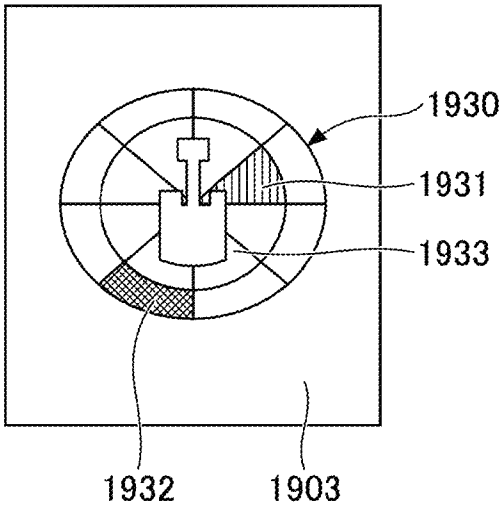
FIG. 9C is a diagram illustrating a modification of the human detection map display area displayed by the display device.

FIGS. 9A to 9C are diagrams illustrating a modification of the human detection map display area displayed by the display device D3.

FIG. 9A illustrates a modification in which, when the determination unit 305 determines that a person who has been previously detected is currently no longer detected, an area in which the person who is currently no longer detected is likely to be present is displayed. In the human detection map display area 1901 illustrated in FIG. 9A, a human detection icon 1911*a* corresponding to a previously detected position of the person is displayed, and an area 1911*b* in which the person is likely to be present is displayed. The area 1911*b* may be displayed such that the area 1911*b* expands over time, taking into account the speed at which the person in question is moving.

In the human detection map display area 1901 illustrated in FIG. 9A, the area in which the person is likely to be present is presented to the operator, and thus the operator can recognize in which area the person is likely to be present. Therefore, the safety can be improved.

FIG. 9B illustrates a modification example in which, when the determination unit 305 determines that a person who has been previously detected is no longer detected at the current time, the display mode of the human detection icon regarding the person who is no longer detected at the current time is changed. In the human detection map display area 1902 illustrated in FIG. 9B, a human detection icon 1921 corresponding to a previously detected position of the person is displayed. The human detection icon 1921 has a diamond shape, and is different in shape from the human detection icon of the detected person (for example, the human detection icon 1922).

In this way, when the determination unit 305 determines that a person who has been previously detected is no longer detected at the current time, the display device D3 changes the display mode of the human detection icon to make the operator recognize the presence of the person who has not been detected at the current time. Note that the display information representing the position of the person may be anything other than the human detection icon, and may be indicated by an area as illustrated in FIG. 9C, for example.

FIG. 9C illustrates a modification of a human detection map display area 1903 displayed by the display device D3. In the human detection map display area 1903 illustrated in FIG. 9C, a circular area 1930 representing the periphery of the shovel 100 is displayed together with a shovel icon 1933 instead of displaying the human detection icon. The circular area 1930 is divided into predetermined areas, and whether or not a person is present in each divided area is indicated by color.

Further, in the human detection map display area 1903, when the determination unit 305 determines that the previously detected person is not detected at the current time, the area in which the previously detected person was present is displayed in a different color from the area where no person is detected.

For example, an area 1931 indicates an area of a person who has previously been detected but is not detected at the current time.

The display device D3 displays the area 1931, and thus the operator can recognize that there is a person who is not detected at the current time.

In the human detection map display area 1903 illustrated in FIG. 9C, the area (for example, the area 1931) in which the previously detected person is not detected at the current time and the area (for example, the area 1932) in which the person is detected at the current time may be displayed in different colors. Therefore, the operator can recognize the current situation in detail by the difference in color when referring to the human detection map display area 1903.

The example in which the human detection map display area 1903 illustrated in FIG. 9C displays the human detection result for 360 degrees around the shovel icon 1933 as a reference has been described. However, the present modification is not limited to the example in which the person detection result is displayed for 360 degrees around the shovel icon 1933 as a reference, and for example, the person detection result may be displayed for 180 degrees rearward or for 270 degrees rearward and on the right side.

The present embodiment is not limited to the continuation of the display of the human detection map display area described above in a case where a previously detected person is not detected at the current time. For example, the controller 30 may display a pop-up screen for attracting attention in addition to the continuation of the display of the human detection map display area. The pop-up screen is displayed as, for example, "There may have been missed information on the previously detected person being not detected at the current time, so please check your surroundings." The pop-up screen is displayed so as not to overlap the first image display area 422 and the second image display area 423. Thus, the operator can recognize the surrounding situation and then identify that no person is detected.

Another Embodiment

In the above-described embodiment, the example in which a person is detected from captured image information captured by the imaging device S6 has been described. However, the above-described embodiment is not limited to the example of detecting a person from the captured image information captured by the imaging device S6. Therefore, in another embodiment, a case where a space recognition device S7 is provided in addition to the imaging device S6 will be described.

Figure 10:
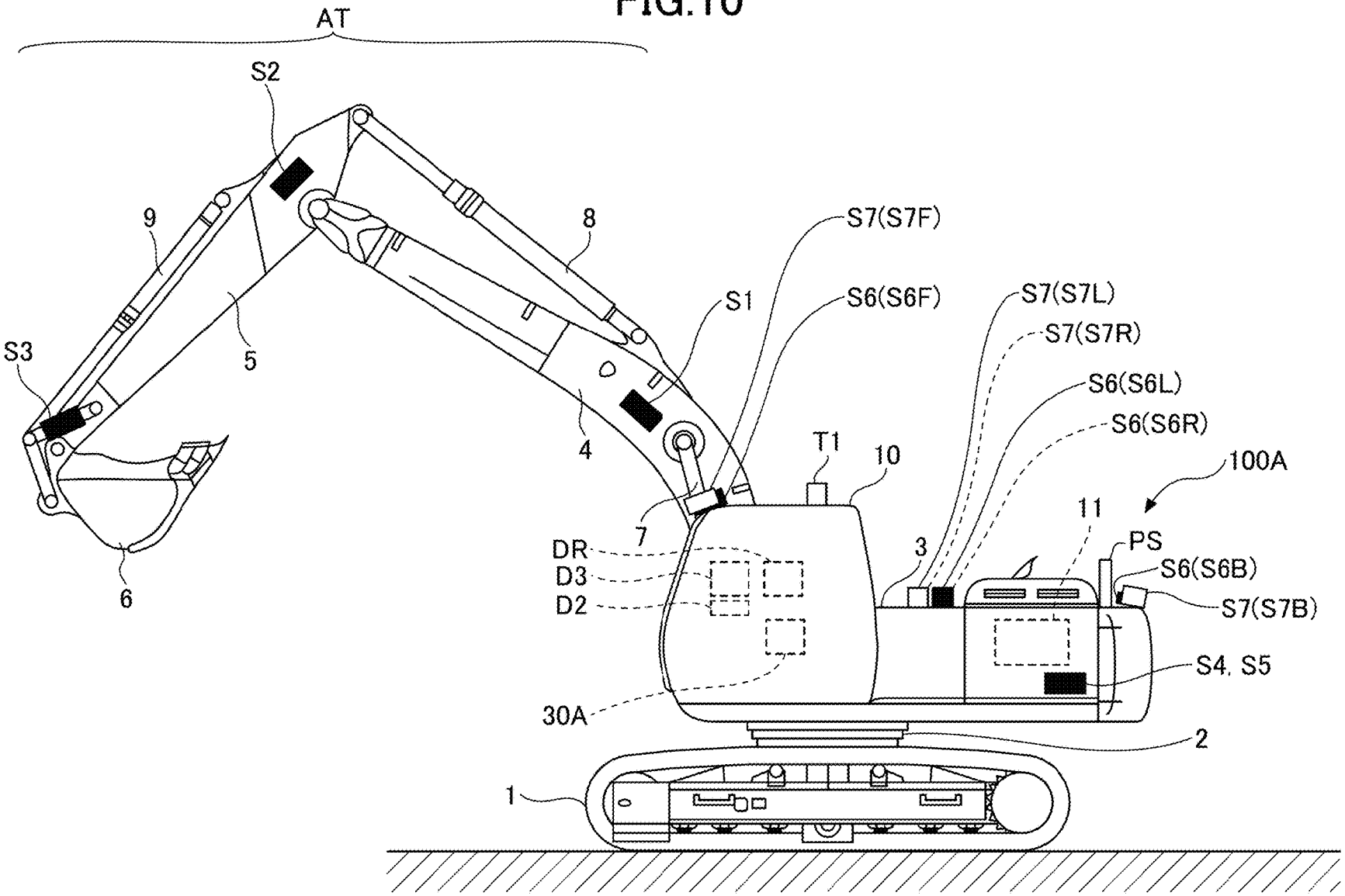
FIG. 10 is a side view of a shovel according to another embodiment.
Figure 11:
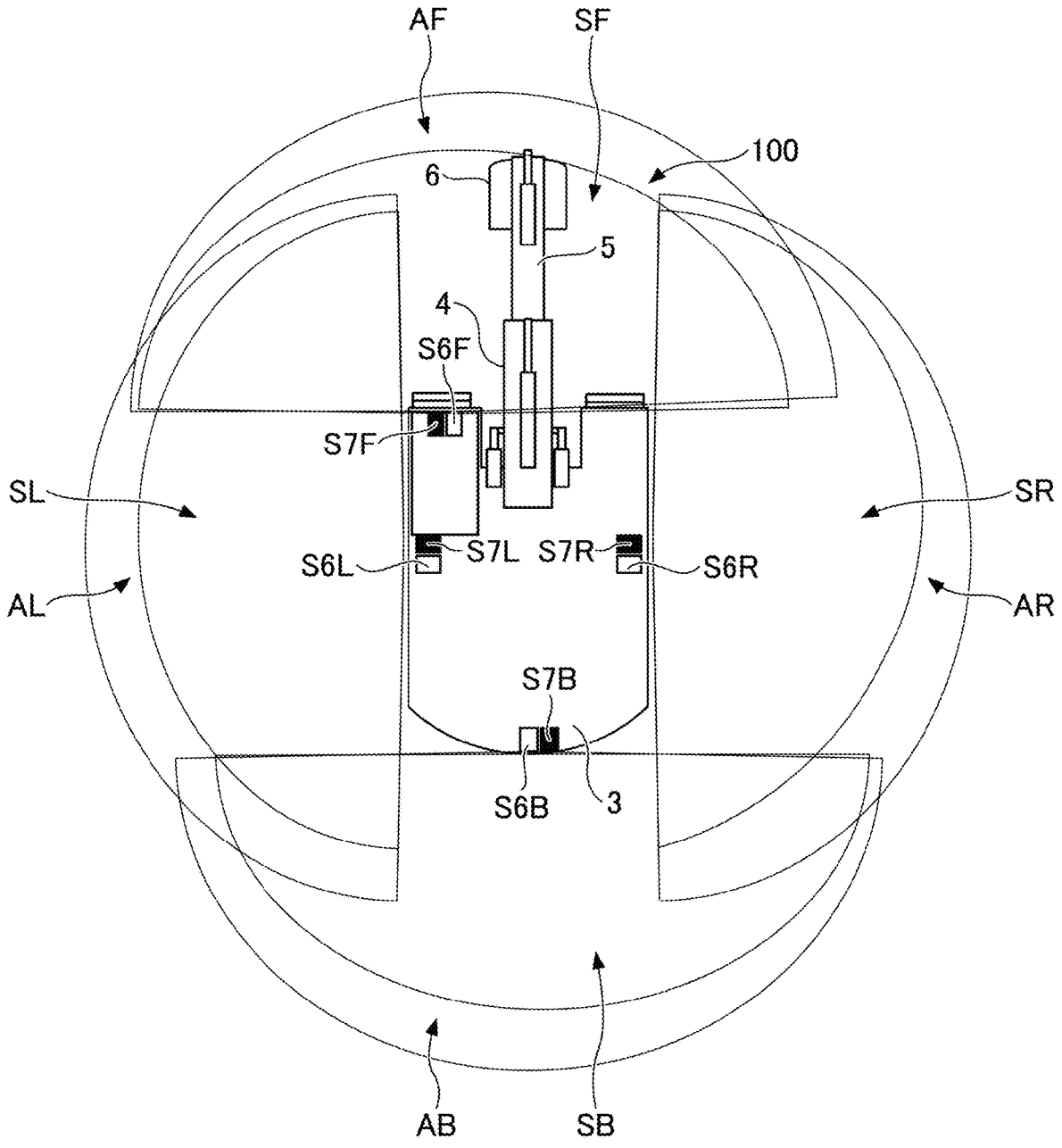
FIG. 11 is a top view of the shovel according to another embodiment.

FIG. 10 is a side view of a shovel 100A according to another embodiment. FIG. 11 is a top view of the shovel 100A according to another embodiment. In the present embodiment, the same reference numerals are assigned to the same components as those in the embodiment, and the description thereof will be omitted.

The space recognition device S7 is an example of a space recognition device, and detects the presence or absence of an object present in the space around the shovel 100A, the distances to the object, and the like. The space recognition device S7 outputs a result of measuring the space to a controller 30A as measurement information.

The space recognition device S7 includes a rear space recognition device S7B that detects a space behind the shovel 100A, a left space recognition device S7L that detects a space to the left of the shovel 100A, a right space recognition device S7R that detects a space to the right of the shovel 100A, and a front space recognition device S7F that detects a space in front of the shovel 100A.

The space recognition device S7 may use a LIDAR to detect an object present around the shovel 100A. The LIDAR measures, for example, distances between the LIDAR and one million or more points within a monitoring range. Note that the present embodiment is not limited to a configuration using LIDAR, and any space recognition device capable of measuring the distances to an object may be used. For example, a stereo camera may be used, or a distance measuring device such as a distance imaging camera or a millimeter wave radar may be used. When the millimeter wave radar or the like is used as the space recognition device S7, a large number of signals (laser light or the like) may be transmitted from the space recognition device S7 toward the object, and the reflection signals may be received to derive the distances and directions of the object from the reflection signals.

The rear space recognition device S7B is attached to the rear end of the upper surface of the upper turning body 3. The left space recognition device S7L is attached to the left end of the upper surface of the upper turning body 3. The right space recognition device S7R is attached to the right end of the upper surface of the upper turning body 3. The front space recognition device S7F is attached to a front end of an upper surface of the cabin 10.

The front space recognition device S7F, the rear space recognition device S7B, the left space recognition device S7L, and the right space recognition device S7R are all attached to the upper turning body 3 such that the optical axes thereof are directed obliquely downward and a part of the upper turning body 3 is included in the detection range. Therefore, the detection range of each of the front space recognition device S7F, the rear space recognition device S7B, the left space recognition device S7L, and the right space recognition device S7R has a viewing angle of about 180 degrees in a top view, for example. In the example of FIG. 11, a detection range SF represents an example of a detection range of the front space recognition device S7F, a detection range SB represents an example of a detection range of the rear space recognition device S7B, a detection range SL represents an example of a detection range of the left space recognition device S7L, and a detection range SR represents an example of a detection range of the right space recognition device S7R.

As illustrated in FIG. 11, the detection ranges SF, SB, SR, and SL are narrower than the imaging ranges AF, AB, AR, and AL, but the detection ranges and the imaging ranges are different depending on the embodiment.

The controller 30A according to the present embodiment can perform the same processing as the controller 30 of the above-described embodiment, and is different from the controller 30 only in that the detection result of the space recognition device S7 is used to estimate the position of the person in the real space, for example, the direction and the distance where the person is present with respect to the shovel 100A.

The controller 30A according to the present embodiment estimates the position of a person in the real space, for example, the direction and the length of the person with respect to the shovel 100A, based on the detection result of the space recognition device S7. A known method may be used as a method of estimating the direction in which and the distance to which the person is present from the detection result, and for example, a trained model may be used. For example, the controller 30A may receive a direction and a distance where a person is present by inputting a detection result of the space recognition device S7 to the trained model.

The display device D3 according to the present embodiment displays, on the display screen, a human detection map display area based on the estimation result of the direction and distance where the person is present by the controller 30A. Information displayed in the other display area is the same as that in the above-described embodiment, and thus the description thereof will be omitted.

That is, the display device D3 according to the present embodiment is configured to display the captured image information captured by the imaging device S6 provided in the upper turning body 3 separately from the space recognition device S7 together with the human detection map display area.

The determination unit 305 according to the present embodiment is not limited to the determination based on the detection result by the space recognition device S7, and may perform the determination by combining the detection result by the space recognition device S7 and the imaging result by the imaging device S6. In the determination, a difference between the detection ranges SF, SB, SR and SL and a detection range in which a person can be detected from the captured image information by the imaging device S6 may be considered. For example, when the determination unit 305 determines that a person who is no longer detected by the space recognition device S7 is detected by the imaging device S6, the display device D3 may display the position of the person in the human detection map display area.

Still Another Embodiment

In the above-described embodiment, the case where the work is performed by the shovel 100 with an operator on board has been described. However, the above-described embodiment is not limited to the example of performing the work when the operator is on board the shovel 100. For example, when the shovel 100 performs work in accordance with remote control, the same display as that in the above-described embodiment may be performed. Therefore, in a still another embodiment, a case where the shovel 100 is remotely operated will be described.

Figure 12:
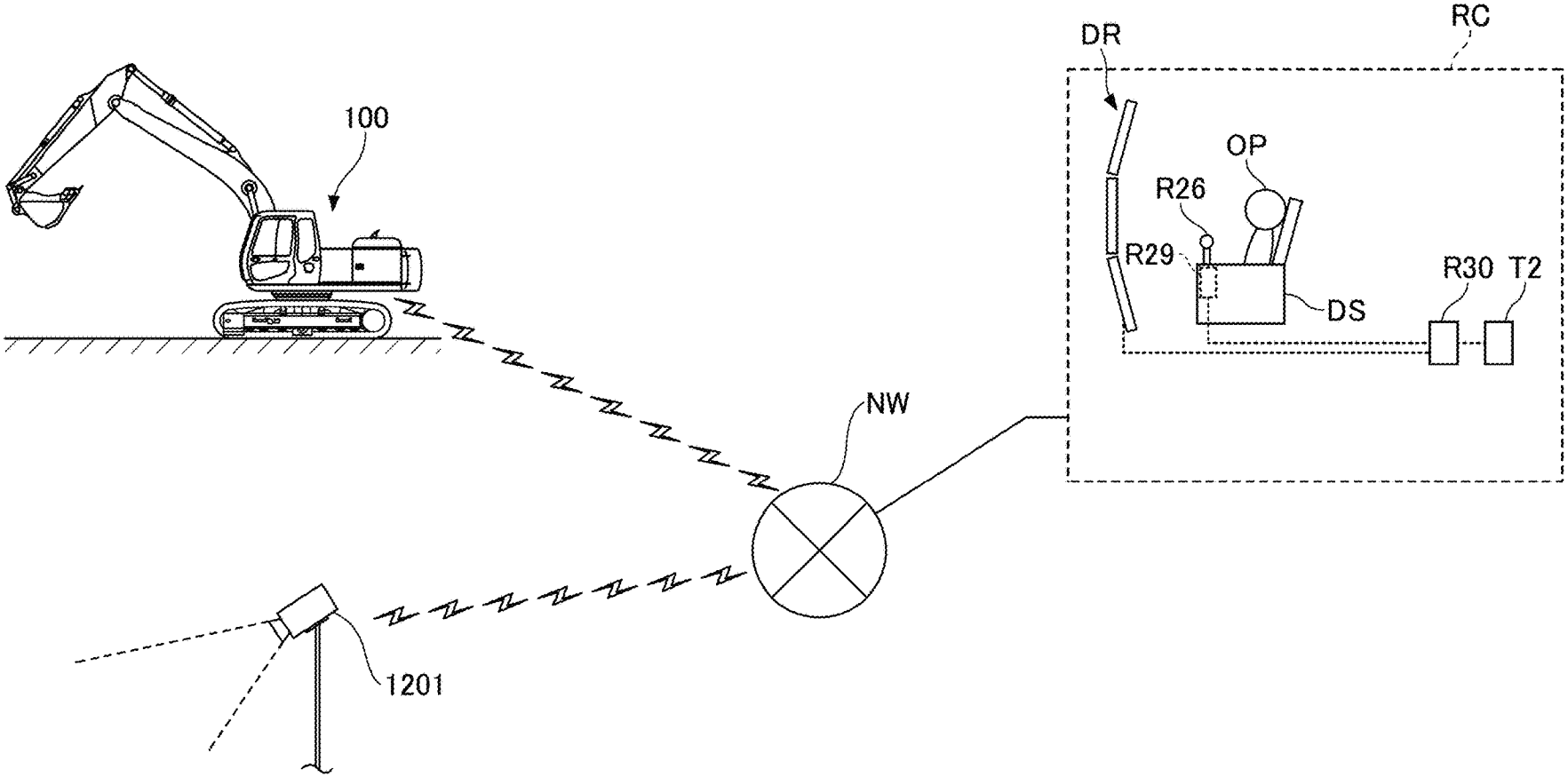
FIG. 12 is a schematic diagram illustrating an example of a remote control system according to a still another embodiment.

Therefore, an outline of a remote control system SYS according to the still another embodiment will be described with reference to FIG. 12. FIG. 12 is a schematic diagram illustrating an example of a remote control system SYS according to the still another embodiment.

As illustrated in FIG. 12, the remote control system SYS according to the still another embodiment includes the shovel 100, a fixed-point camera 1201, and a remote control room RC.

The shovel 100 and the remote control room RC are connected to each other via a communication line NW so as to be able to transmit and receive data.

The shovel 100 can perform wireless communication by using the communication device T1. The shovel 100 can transmit and receive data to and from a device (for example, the remote control room RC) connected to the communication line NW.

Then, the shovel 100 can transmit information on a work site to the remote control room RC. Thus, the remote control room RC can check the work site in accordance with the information from the shovel 100. In the present embodiment, a device that measures the work site is not limited to the shovel 100, and may be a device of another aspect such as a drone flying over the work site, a fixed-point camera, or an imaging device that can be carried by the user.

For example, the shovel 100 is provided with an imaging device S6. The shovel 100 transmits captured image information indicating an imaging result of the work site by the imaging device S6 to the remote control room RC. Alternatively, the fixed-point camera 1201 provided in the work site transmits captured image information indicating an imaging result of the work site to the remote control room RC. The device that monitors the work site is not limited to the fixed-point camera 1201, and may be a drone that flies over the work site or an imaging device that can be carried by the user. The drone or the imaging device may transmit captured image information indicating an imaging result of the work site to the remote control room RC.

The number of shovels 100 included in the remote control system SYS may be one or more. Accordingly, the remote control system SYS can provide information on the work site to the remote control room RC through the plurality of shovels 100.

Configuration Example of Remote Operation Room

The remote control room RC includes a communication device T2, a remote controller R30, an operation device R26, an operation sensor R29, and a display device DR. In addition, an operation seat DS on which an operator OP who remotely controls the shovel 100 sits is installed in the remote control room RC.

The communication device T2 is configured to control communication with the communication device T1 attached to the shovel 100.

The remote controller (an example of a remote control device) R30 is a calculation device that executes various calculations. In the present embodiment, the remote controller R30 is configured by a microcomputer including circuitry, or a central processing unit (CPU) and a memory. The various functions of the remote controller R30 are implemented by the CPU executing the programs stored in the memory.

The display device DR displays a screen based on the information transmitted from the shovel 100 so that the operator OP in the remote control room RC can visually recognize the surroundings of the shovel 100. The display device DR can confirm the situation of the work site including the surroundings of the shovel 100 even though the operator is in the remote control room RC.

Further, the display device DR displays the display screen including the human detection map display area together with the captured image information, as in the embodiment.

The operation device R26 is provided with the operation sensor R29 for detecting the operation content of the operation device R26. The operation sensor R29 is, for example, an inclination sensor that detects an inclination angle of the operation lever, an angle sensor that detects a turning angle of the operation lever around a turning shaft, or the like. The operation sensor R29 may be configured by other sensors such as a force sensor, a current sensor, a voltage sensor, or a distance sensor. The operation sensor R29 outputs information on the detected operation content of the operation device R26 to the remote controller R30. The remote controller R30 generates an operation signal based on the received information and transmits the generated operation signal to the shovel 100. The operation sensor R29 may be configured to generate an operation signal. In this case, the operation sensor R29 may output the operation signal to the communication device T2 without passing through the remote controller R30. Thus, the remote control of the shovel 100 can be implemented from the remote control room RC.

The communication device T1 of the shovel 100 receives the operation signal from the communication device T2 of the remote controller R30. The controller 30 of the shovel 100 performs various operations at the work site based on the received operation signal.

In the present embodiment, the remote controller R30 displays a display screen including the human detection map display area together with the captured image information on the display device DR. Further, when a person is no longer detected from the captured image information by the imaging device S6, the remote controller R30 performs the same control as in the above-described embodiment. Thus, the present embodiment can obtain the same effects as those of the above-described embodiment. In the present embodiment, the display of the display screen including the human detection map display area together with the captured image information is not limited to the display device in the remote control room RC, and for example, the display screen may be displayed on a display device or the like provided in a management center for managing the work site.

Action

In the above-described embodiments, the controller 30, 30A, the display device D3, or the remote controller R30 displays the display screen by the above-described control, and thus, when there is a possibility that a person is present around the shovel, the operator can recognize that there is a possibility that a person is present. Therefore, the operator can operate the shovel in consideration of the possibility that a person is present around the shovel, and thus, improvement in safety can be achieved.

Although the embodiments of the shovel and the control system for the shovel according to the present disclosure have been described above, the present disclosure is not limited to the above-described embodiments and the like. Various changes, modifications, substitutions, additions, deletions, and combinations are possible within the scope of the claims. Such modifications are also included in the technical scope of the present disclosure.

What is claimed is:

1. A shovel comprising:

a lower traveling body;

an upper turning body turnably mounted on the lower traveling body;

an imaging device attached to the upper turning body;

a display device; and circuitry configured to display, on the display device, position information representing a relationship between positions of a person detected by the imaging device and the shovel and when the person whose position is represented in the position information is no longer detected by the imaging device, continue to display the position of the person who is no longer detected in the position information in a case where a predetermined condition is satisfied, wherein the predetermined condition is based on a positional relationship between a detection range in which the person can be detected by the imaging device and the position of the person who is no longer detected, and the predetermined condition is a condition that a last detected position of the person is not a position at which the person is able to move to an outside of the detection range or that the last detected position of the person is a position at which the person is able to move toward the shovel side from the detection range.

2. The shovel according to claim 1, wherein when the imaging device is a camera, the circuitry is configured to display, on the display device, an image captured by the camera, or an image captured by a different camera provided in the upper turning body separately from the camera, together with the position information.

3. The shovel according to claim 2, wherein the circuitry is configured to display, on the image, an area in which the person is detected and associate the area with the position of the person represented in the position information.

4. A shovel comprising:

a lower traveling body;

an upper turning body turnably mounted on the lower traveling body;

an imaging device attached to the upper turning body;

a display device; and circuitry configured to display, on the display device, position information representing a relationship between positions of a person detected by the imaging device and the shovel and when the person whose position is represented in the position information is no longer detected by the imaging device, continue to display the position of the person who is no longer detected in the position information in a case where a predetermined condition is satisfied, wherein when the imaging device is a camera, the circuitry is configured to display. on the display device, an image captured by the camera, or an image captured by a different camera provided in the upper turning body separately from the camera, together with the position information, the circuitry is configured to display, on the image, an area in which the person is detected and associate the area with the position of the person represented in the position information, and when the person whose position is represented in the position information is no longer detected by the imaging device, the circuitry continues to display the position of the person who is no longer detected in the position information and inhibits display of the area in a case where the predetermined condition is satisfied.

5. The shovel according to claim 1, wherein when the person whose position is represented in the position information is no longer detected by the imaging device, the circuitry changes a display mode of display information representing the position of the person who is no longer detected in a case where the predetermined condition is satisfied.

6. A control system for a shovel, the control system comprising:

a shovel including a lower traveling body, an upper turning body turnably mounted on the lower traveling body, and an imaging device attached to the upper turning body;

a display device; and circuitry configured to display, on the display device, position information representing a relationship between positions of a person detected by the imaging device and the shovel and when the person whose position is represented in the position information is no longer detected by the imaging device, continue to display the position of the person who is no longer detected in the position information in a case where a predetermined condition is satisfied, wherein the predetermined condition is based on a positional relationship between a detection range in which the person can be detected by the imaging device and the position of the person who is no longer detected, and the predetermined condition is a condition that a last detected position of the person is not a position at which the person is able to move to an outside of the detection range or that the last detected position of the person is a position at which the person is able to move toward the shovel side from the detection range.

* * * * *